US010094158B2

(12) United States Patent
McRoskey et al.

(10) Patent No.: US 10,094,158 B2
(45) Date of Patent: Oct. 9, 2018

(54) DOOR SAFETY BUMPER

(71) Applicant: Carlsbad Safety Products, LLC, Carlsbad, CA (US)

(72) Inventors: Daniel A. McRoskey, Rancho Santa Fe, CA (US); Peter K. McRoskey, Cardiff-By-The-Sea, CA (US)

(73) Assignee: Carlsbad Safety Products, LLC, Carlsbad, CA (US)

( * ) Notice: Subject to any disclaimer, the term of this patent is extended or adjusted under 35 U.S.C. 154(b) by 65 days.

(21) Appl. No.: 15/292,888

(22) Filed: Oct. 13, 2016

(65) Prior Publication Data

US 2017/0101815 A1 Apr. 13, 2017

Related U.S. Application Data

(60) Provisional application No. 62/361,860, filed on Jul. 13, 2016, provisional application No. 62/348,678, filed on Jun. 10, 2016, provisional application No. 62/240,785, filed on Oct. 13, 2015.

(51) Int. Cl.

| | |
|---|---|
| ***E05F 5/06*** | (2006.01) |
| ***E06B 7/36*** | (2006.01) |
| ***E05F 5/02*** | (2006.01) |
| *E05F 5/04* | (2006.01) |

(52) U.S. Cl.

CPC ..... *E05F 5/06* (2013.01); *E05F 5/02* (2013.01); *E06B 7/36* (2013.01); *E05F 2005/046* (2013.01); *Y10T 16/6285* (2015.01); *Y10T 292/0902* (2015.04)

(58) Field of Classification Search

CPC ..... E06B 7/36; E05F 5/06; E05F 5/02; E05F 5/04; E05F 2005/043; E05F 2005/046; Y10T 292/0902; Y10T 16/61; Y10T 16/615; Y10T 16/625; Y10T 16/628; Y10T 16/6285; Y10T 16/629

See application file for complete search history.

(56) References Cited

U.S. PATENT DOCUMENTS

| | | | |
|---|---|---|---|
| 83,967 | A | 11/1868 | Howell |
| 377,852 | A | 2/1888 | Giesy |
| 463,821 | A | 11/1891 | Wright |
| 812,476 | A | 2/1906 | Becker |

(Continued)

FOREIGN PATENT DOCUMENTS

| | | | |
|---|---|---|---|
| GB | 2213519 | A | 8/1989 |

*Primary Examiner* — Jeffrey O'Brien
(74) *Attorney, Agent, or Firm* — Breakwater Law Group

(57) ABSTRACT

A door safety device generally includes a mounting member for coupling the device to a door and a blocking member for preventing complete closure of the door when the mounting member is attached to the door and the device is in a blocking configuration. The device can also include an intermediate member coupled between the mounting member and the blocking member. The intermediate member defines a first hinge axis extending in a direction parallel to the surface of the door and parallel to an edge of the door. The blocking member is movable (e.g., rotatable or revolvable) about the first hinge axis, at least when the mounting member is coupled to the door and the device is in a blocking configuration, so as to inhibit the transfer of detachment forces from the blocking member to the mounting member upon impact.

20 Claims, 15 Drawing Sheets

(56) References Cited

U.S. PATENT DOCUMENTS 890,207 A 6/1908 Anderson
978,870 A 12/1910 Fleming
1,037,641 A 9/1912 Koch, Jr.
1,258,856 A 3/1918 Beaudette
1,616,265 A 2/1927 Kroehling
1,944,101 A 1/1934 Meier
2,065,685 A 12/1936 Gaisman
2,150,435 A 3/1939 Floreth
2,175,403 A 10/1939 Larson
2,592,230 A 4/1952 Allen
2,807,044 A * 9/1957 Blondy ..... E05F 5/04 16/86 A
2,846,713 A * 8/1958 Shankwiler ..... E05C 19/02 16/83
3,055,043 A * 9/1962 Luttner, Jr. ..... E05F 5/04 16/86 B
3,172,168 A * 3/1965 Suska ..... E05F 5/04 16/82
3,200,434 A * 8/1965 Jarnot ..... E05F 5/04 16/86 A
3,325,854 A 6/1967 Steigerwald
3,620,483 A * 11/1971 Weinberger ..... E05C 17/54 16/82
3,800,360 A * 4/1974 Knarreborg ..... E05F 5/04 16/83
4,015,867 A 4/1977 Siden
4,261,140 A 4/1981 McLean
4,368,555 A 1/1983 Salerno
4,648,152 A 3/1987 Grewall
4,738,002 A 4/1988 Shank
4,831,688 A 5/1989 Deininger
4,982,474 A * 1/1991 Kjellstrom ..... E05C 17/04 16/82
5,027,471 A 7/1991 Barnes
5,044,681 A 9/1991 Neighbors
D346,109 S * 4/1994 Comaianni ..... E05F 5/04 D8/402
5,369,840 A 12/1994 Salvador
5,509,235 A 4/1996 Chander
5,511,837 A 4/1996 Dempsey
5,581,844 A 12/1996 Raheb
5,680,675 A 10/1997 Davis
5,711,557 A 1/1998 Nicolosi
5,711,560 A 1/1998 Gilbertson
6,003,911 A 12/1999 Sowash
6,327,743 B1 * 12/2001 Rashid ..... E05B 17/005 16/82
6,431,620 B2 8/2002 Tremblay
6,487,751 B2 12/2002 Renaud
6,510,587 B2 * 1/2003 Urschel ..... E05B 17/005 16/82
6,550,186 B2 * 4/2003 Haq ..... E05F 5/02 16/83
6,604,764 B2 * 8/2003 Zemzik ..... E05C 19/188 292/288
6,874,198 B2 * 4/2005 Renaud ..... E05B 17/005 16/65
7,937,806 B1 * 5/2011 Doyle ..... E05F 5/02 16/82
8,276,240 B2 * 10/2012 Ritachka ..... E05F 5/02 16/82
8,595,899 B2 * 12/2013 McRoskey ..... E05F 5/04 16/82
8,776,316 B2 * 7/2014 McRoskey ..... E05F 5/02 16/82
8,950,040 B2 * 2/2015 McRoskey ..... E05F 5/04 16/82
9,074,396 B2 * 7/2015 Packer ..... E05C 17/54
9,316,033 B2 * 4/2016 Yates ..... E05C 17/54
9,752,350 B2 * 9/2017 Davis ..... E05B 17/005
2006/0162255 A1 * 7/2006 Lee ..... E06B 7/36 49/383
2007/0028417 A1 * 2/2007 Emmitt ..... E05F 5/04 16/82
2009/0255085 A1 * 10/2009 Lorenzati ..... E05F 5/04 16/82
2009/0320237 A1 * 12/2009 Kersting ..... E05F 5/06 16/82

* cited by examiner

DOOR SAFETY BUMPER

CROSS-REFERENCE TO RELATED APPLICATIONS

This application claims the benefit of U.S. Provisional Application No. 62/361,860, filed Jul. 13, 2016; and of U.S. Provisional Application No. 62/348,678, filed Jun. 10, 2016; and of U.S. Provisional Application No. 62/240,785, filed Oct. 13, 2015; the disclosure of each of which is incorporated herein by reference in its entirety.

BACKGROUND OF THE INVENTION

Field of the Invention

This application relates to safety devices. More particularly, this application relates to door-mountable devices for preventing full closure of a door and thereby preventing finger injuries.

Description of the Related Technology

It is a sad fact of modern living that most children and even adults have at some point in their life injured a finger in the jamb of a closing door. For large and heavy doors, the closing door can become an almost unstoppable swinging lever arm with immense crushing power. These accidents can be extremely painful and can break bones and can actually sever fingers.

Conventional guards are known to help prevent fingers from entering the gap between the hinged edge of the door and the door jamb. However, efforts to date to prevent the crushing of fingers positioned between the door on the latch side, and the jamb have been less than successful. Often, if in a hurry, one will close a door by simply grabbing the edge of the door and swinging it closed behind them as they pass through. This inattention to a common task greatly increases the chance of a finger getting caught between the closing door and the jamb.

Similarly, for sliding doors with no knob present, one may similarly grab the edge of the door and slide the door into the closed position with fingers directly in the path of the crushing force of the sliding door.

As such, there is a continuing unmet need for a cost effective and easily engaged device that provides protection for fingers positioned between the jamb and the latch side of closing doors.

SUMMARY

In a first aspect, a door safety device comprises a mounting member configured to couple to a surface of a door, a blocking member configured to prevent complete closure of the door, at least when the mounting member is attached to a surface of the door and the device is in a blocking configuration, and an intermediate member coupled between the mounting member and the blocking member. The intermediate member defines a first hinge axis, the first hinge axis configured to extend in a direction parallel to the surface of the door and parallel to an edge of the door, at least when the mounting member is coupled to the surface of the door. The blocking member is movable about the first hinge axis relative to the surface of the door, at least when the mounting member is coupled to the surface of the door and the device is in a blocking configuration. In some embodiments, the blocking member is configured to move from an initial blocking configuration to a blocking orientation upon impact with a door jamb, the blocking orientation being angled with respect to the initial blocking configuration. In some embodiments, the blocking member comprises a resilient member. In some embodiments, the blocking member comprises an elastomer. In some embodiments, the blocking member comprises foam. In some embodiments, the mounting member comprises a clip configured to grip opposing surfaces of the door. In some embodiments, the device further comprises a tacky material disposed one at least one gripping surface of the clip. In some embodiments, the mounting member comprises an adhesive. In some embodiments, the mounting member comprises a hook-and-loop fastener. In some embodiments, the intermediate member comprises a tongue portion of a leg of the clip, the tongue portion being movable with respect to the remainder of the leg about the first hinge axis. In some embodiments, the blocking member is coupled to the tongue portion. In some embodiments, the blocking member is coupled to the remainder of the leg of the clip. In some embodiments, the intermediate member comprises a V-shaped member, a first leg of the V-shaped member being coupled to the mounting member, a second leg of the V-shaped member being coupled to the blocking member, and an apex of the V-shaped member defining the first hinge axis. In some embodiments, the device further comprises a second hinge member defining a second hinge axis, wherein the blocking member is movable about the second hinge axis relative to the surface of the door, at least when the mounting member is coupled to the surface of the door and the device is in a blocking configuration. In some embodiments, the blocking member is movable between the blocking configuration and a stored configuration in which the blocking member does not prevent complete closure of the door. In some embodiments, the device further comprises a pivot member defining a pivot axis, wherein the blocking member is configured to rotate about the pivot axis as it moves from the blocking configuration to the stored configuration. In some embodiments, the pivot axis extends in a direction normal to the surface of the door.

In another aspect, a door safety device comprises a blocking member configured to receive the impact of a door frame or door jamb during an attempted closure of the door and to prevent complete closure of the door, an attachment member configured to couple the blocking member to the door, and a remedial member configured to enable the blocking member to move about an axis extending in a direction parallel to a surface of the door and parallel to an edge of the door at least when the blocking member is impacted by the door frame or door jamb so as to inhibit transfer of detachment forces from the blocking member to the attachment member during impact. In some embodiments, the detachment forces include a component extending in a direction normal to the surface of the door and away from the surface of the door.

In another aspect, a door safety device comprises a base member configured to attach to a surface of a door, a blocking member operatively coupled to the base member, the blocking member being movable relative to the base member, upon impact of the blocking member with a door frame or door jamb, between a first position in which the blocking member extends beyond an edge of the door at a first angle with respect to the surface of the door, and a second position in which the blocking member extends beyond the edge of the door at a second angle with respect to the surface of the door.

BRIEF DESCRIPTION OF THE DRAWINGS

These and other features, aspects, and advantages are described below with reference to the drawings, which are intended to illustrate, but not to limit, the invention. In the drawings, like reference numerals denote like features throughout various embodiments.

DETAILED DESCRIPTION OF CERTAIN INVENTIVE EMBODIMENTS

Figure 1A:
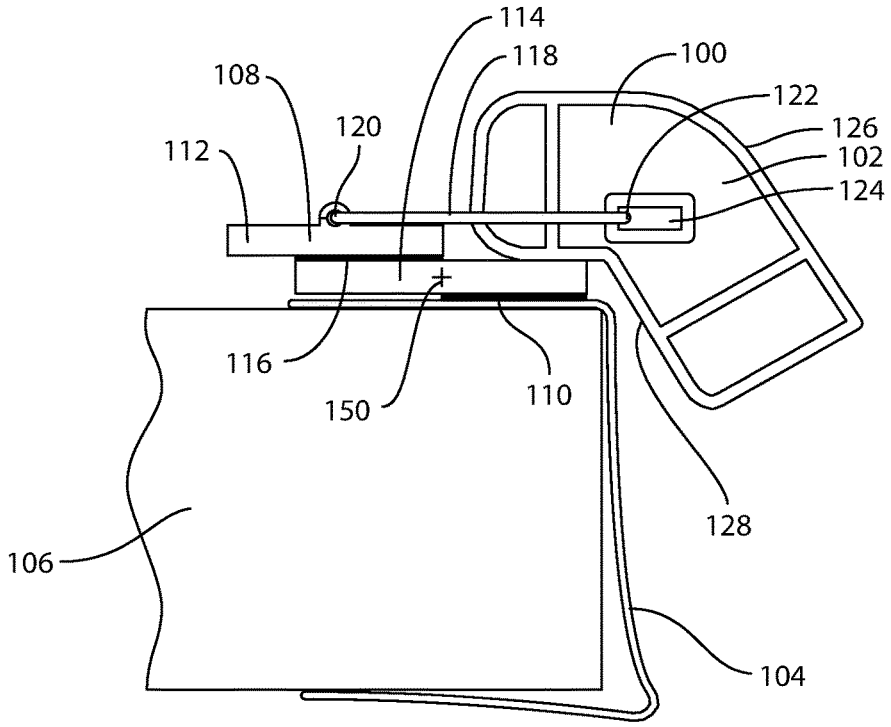
FIG. 1A illustrates a side view of one example of a door safety device, configured in accordance with an embodiment, shown coupled to a door and in an initial or blocking configuration.

Before explaining any embodiments in detail, it is to be understood that embodiments are not limited in their application to the details of construction and to the arrangement of the components in the following description or illustrated in the drawings. Other embodiments may be practiced and carried out in various ways which will be understood to those skilled in the art. Also, it is to be understood that the phraseology and terminology employed herein are for the purpose of description and should not be regarded as limiting. As such, those skilled in the art will appreciate that the conception upon which this disclosure is based may readily be utilized as a basis for designing of other structures, methods and systems for carrying out the several purposes of the disclosed embodiments in the protection of fingers and the like from closing doors. It is important, therefore, that the claims be regarded as including such equivalent construction and methodology insofar as they do not depart from the spirit and scope of the present invention.

The devices and methods herein disclosed and described achieve the above-mentioned goals through the provision of a resilient member that is adapted to absorb and dissipate the force of a door impacting a door jamb when the resilient member is mounted to the edge of the door, and to prevent the door from fully closing as it approaches the door jamb, leaving a gap between the edge of the door and the door jamb of at least a finger's width. Embodiments can also be adapted for use in connection with a sliding door to prevent full closure of the sliding door.

In accordance with several embodiments, a door safety device for preventing injury during an attempted closing of a hinged or sliding door generally includes a blocking member or body, and a mounting member configured to directly or indirectly attach to a surface or edge of the door. The body is operatively coupled to the mounting member by a pivot member, and movable between first and second positions with respect to the base member. In the first position, which may also be referred to as a "blocking configuration," the body is disposed so as to block or prevent complete closure of the door and maintain a space between an edge of the door and a door jamb. In the second position, which may also be referred to as a "stored configuration," the body is disposed so as to allow complete closure of the door. In embodiments, one or more hinge members can be configured to define one or more hinge axes and/or pivot axis about which the body can rotate, pivot, or flex, from an initial blocking configuration to a blocking orientation (which may be angled with respect to the initial blocking configuration) during impact of the device with the door frame or door jamb.

When a loose blocking member (i.e., one that is unattached to the door), and particularly an elongate blocking member, is placed between a door and a door jamb, the member will tend to orient itself at an angle (e.g., an angle of between about 30 and 60 degrees, for example an angle of 45 degrees) with respect to the surface of the door upon impact. This angled orientation can be referred to as a "blocking orientation". If the blocking member is in some way attached to the door, e.g. through a base member or mounting member such as an adhesive layer or clip coupled to the surface or the edge of the door, the tendency of the blocking member to move from an initial orientation into this blocking orientation can result in forces which tend to pull on the base member or mounting member and, potentially, result in detachment of the base member and/or mounting member from the door. These forces can be referred to as "detachment forces," and include at least forces in a direction normal to and away from the surface of the door, which forces are generated when the blocking member impacts the door jamb or other structure during an attempted closure. Embodiments of the invention seek to mitigate these detachment forces, for example by decoupling the movement of the blocking member upon impact (from an initial position or blocking configuration toward a blocking orientation) from any movement of the base member or mounting member to which it is attached, and/or by orienting the blocking member in the blocking orientation even before impact so that it does not need to move further in order to achieve the blocking orientation.

Figure 1B:
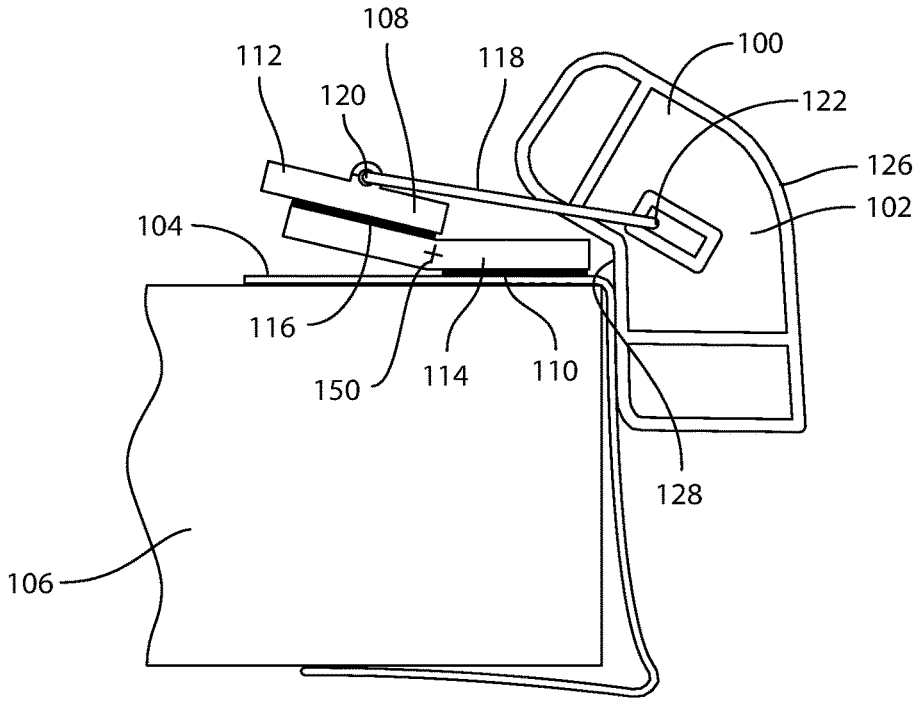
FIG. 1B illustrates another side view of the door safety device of FIG. 1A, shown in a blocking orientation.

In one embodiment, as illustrated in FIGS. 1A and 1B, a door safety device can generally include a blocking member or body 102 and a mounting member 104. The mounting member 104 comprises a clip, such as a spring clip, which is configured to attach to the edge of a door 106, for example by gripping the edge of the door from both sides. The blocking member 102 can be operatively coupled to the mounting member 104 via an intermediate member 108, which can in turn be coupled to the surface of the door 106 via a fastener 110. In the embodiment illustrated in FIGS. 1A and 1B, the intermediate member 108 includes a base 112 and a flexible member 114. The flexible member 114 is coupled on one side to the base 112 via a fastener 116, and on the other side to the mounting member 104 via the fastener 110. Each of the fasteners 110 and 116 can comprise an adhesive, an adhesive strip, a hook-and-loop-fastener, and/or any other suitable fastener.

In the embodiment illustrated in FIGS. 1A and 1B, the blocking member 102 is coupled to the intermediate member 108 via a pivot member 118. Although the illustrated pivot member 118 is coupled to the intermediate member 108 at the base 112, in some embodiments, a pivot member 118 can be coupled directly to the flexible member 118, without provision of a base. The pivot member 118 can be an elongate member such as a wire, and can be coupled to the intermediate member 108 and to the blocking member 102 at respective hinges 120, 122. In embodiments, the hinge 120 can be configured to allow rotation of the pivot member 118 (and, thus, the blocking member 102) about the pivot axis of hinge 120 in a clockwise direction by, for example, between about 60 and 180 degrees, so that the blocking member 102 can be moved by a user from the blocking configuration illustrated in FIG. 1A, to a stored configuration in which the door can be completely closed.

As illustrated in FIG. 1A, the body can include a hole or slot 124 in which the pivot member 118 can move (e.g., can translate and/or move laterally, in addition to rotating about the hinge 122), so as to provide one or more additional degrees of freedom of movement of the blocking member 102 with respect to the pivot member 118 when in the blocking configuration. The hole can be a circular hole, or can be elongate slot, such as the straight slot 124 shown in FIG. 1A. In some embodiments, the hole can be a curved slot. For example, the slot can have a concave curvature facing the corner of the door when the device is attached to the door. Further, the slot can be oriented in the direction illustrated in FIG. 1A, or can be oriented perpendicular to, or otherwise angled with respect to the direction of the slot 124 illustrated in FIG. 1A.

With continued reference to FIG. 1A, the blocking member 102 can, in some embodiments, include a curved leading edge 126 which can help to deflect impact forces upon the blocking member 102 as the door closes. Providing a curved leading edge can allow the leading edge to move (and the blocking member 102 to rotate about the hinge 122) as the leading edge makes contact with the door frame or jamb. In some embodiments, the body can also include a cutout section 128 spanning greater than 90 degrees, as shown in FIG. 1A, so that the blocking member 102 can swivel about the distal end of the 118 pivot member, at least when in the first position, for example as illustrated in FIG. 1B, so that it can wedge in between the edge of the door and the door jamb, preventing complete closure of the door and maintaining at least a finger's width of space between the door and the door jamb. Such a configuration can help to facilitate smooth seating of the blocking member 102 about the edge of the door 106 during an attempted closure of the door, into a blocking orientation, while avoiding detachment forces (e.g., forces that might otherwise pull on or detach the base 112 from the mounting member 104 or the mounting member 104 from the surface of the door 106). The cutout area can span any suitable arc, such as, for example, about 95, 100, 110, 120, 130, 140, 150, 160, or 170 degrees, or a number of degrees greater than or less than any of these numbers, or within a range defined by any two of these numbers.

The flexible member 114 can, in some embodiments, comprise a strip of flexible material, such as a foam or elastomeric material. A first portion of the flexible member 114, nearest the edge of the door 106, is adhered to (or otherwise coupled to) the surface of the door on the side of the flexible member facing the door by adhesive 110, but has no adhesive (or other coupling member) on the side facing away from the door. A second portion of the flexible member 114, further from the edge of the door 106, has no adhesive (or other coupling) on the side of the flexible member facing the door, but is adhered to (or otherwise coupled to) the base 112 on the side of the flexible member facing away from the door, by fastener 116. The point at which the adhesive 110 on the door side ends thus acts as a hinge, allowing the second portion of the flexible member 114 (and the base 112 which is attached thereto) to pivot about a hinge axis 150, away from the surface of the door 106 (see FIG. 1B) as the blocking member 102 impacts the door jamb or frame during an attempted closure of the door. In the initial orientation illustrated in FIG. 1A, the base 112 extends in a direction substantially parallel to the surface of the door. During an attempted closure of the door, as the blocking member 102 impacts the door jamb or door frame, the base 112 can flex away from the door at this hinge axis 150, as illustrated in FIG. 1B, without pulling on the coupling between the flexible member 114 and mounting member 104 or on the coupling between the mounting member 104 and the door 106. The flexibility of the intermediate member 108 (with respect to the mounting member 104) also allows the blocking member 102 more play (e.g., allows it to move and/or rotate more freely about the other end of the pivot member 118) as it impacts the door jamb and seats itself on the edge of the door. Thus, the device 100 is configured such that the blocking member 102 can rotate about one or more of the hinge axis 150, the hinge 120, and the hinge 122 as the blocking member 102 impacts the door jamb or door frame.

Although the embodiment illustrated in FIGS. 1A and 1B includes a foam strip which defines a hinge, one of skill in the art will understand that, in embodiments, the base can be coupled to the mounting member by any suitable mechanism (e.g., any suitable hinge mechanism, spring mechanism, etc.) which allows the base to pull away or pivot away from the surface of the door while avoiding pulling on the coupling which secures the base to the mounting member and/or pulling on the coupling which secures the mounting member to the door.

Figure 2A:
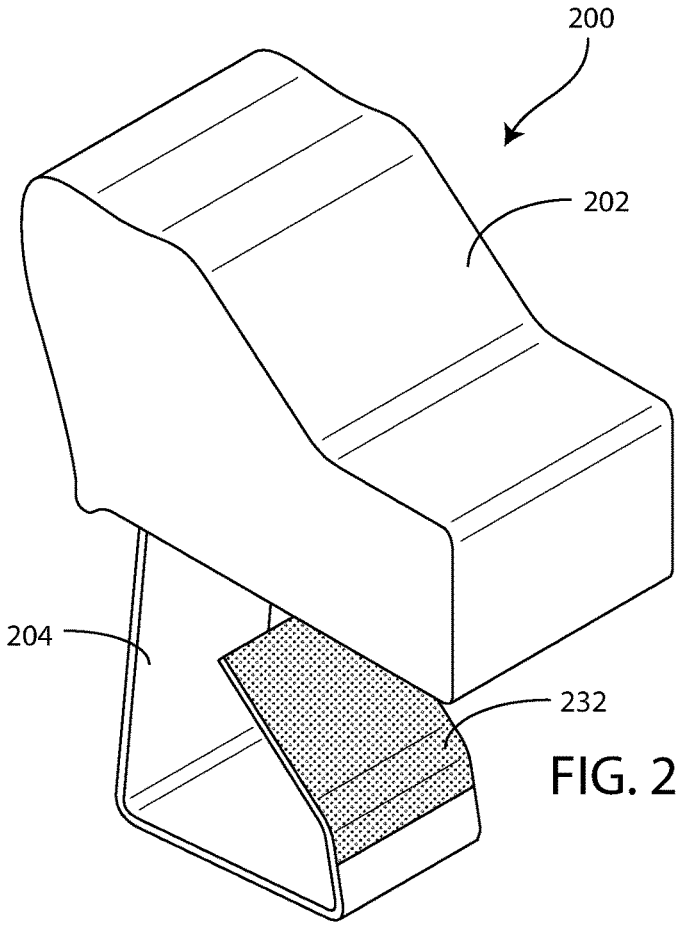
FIG. 2A illustrates a top perspective view of another example of a door safety device, configured in accordance with an embodiment, and shown in an initial or blocking configuration.
Figure 2B:
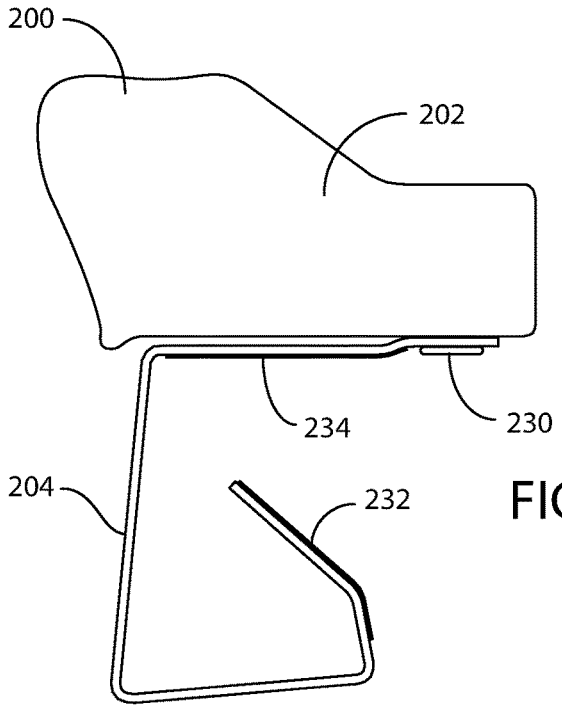
FIG. 2B illustrates a side view of the door safety device of FIG. 2A, shown in a blocking configuration.
Figure 2C:
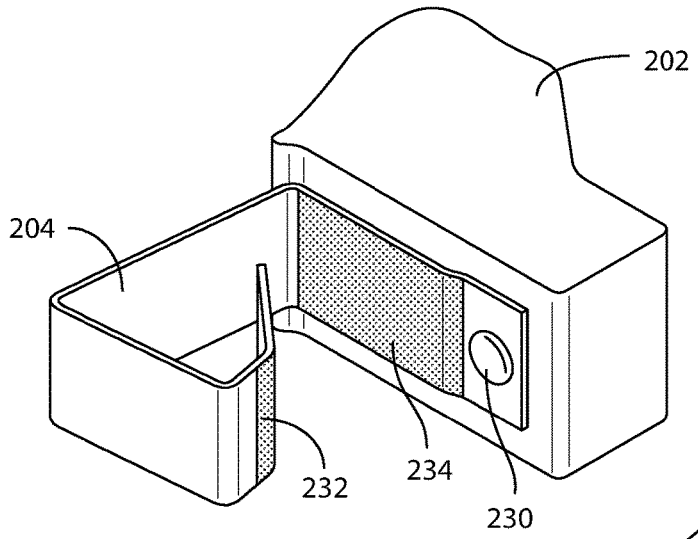
FIG. 2C illustrates a bottom perspective view of the door safety device of FIG. 2A, also in a blocking configuration.

Another embodiment of a door safety device 200 is illustrated in FIGS. 2A-2G. FIGS. 2A and 2B show a blocking member 202 comprising a block of resilient foam, attached to a base member 204 which also functions as a mounting member. The base/mounting member 204 can be a clip, similar to the one illustrated in FIGS. 1A and 1B, which is configured to grip the edge of the door from both sides. As illustrated in FIG. 2C, the mounting member 204 can include a tacky material 232, 234 disposed on one or more gripping surfaces of the mounting member 204.

Figure 2D:
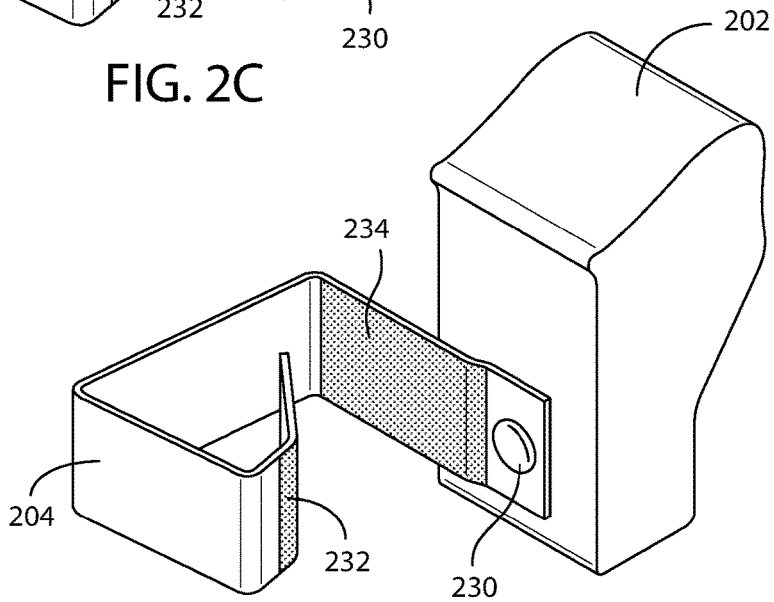
FIG. 2D illustrates a bottom perspective view of the door safety device of FIG. 2A, with the blocking member moved to a stored configuration.
Figure 2E:
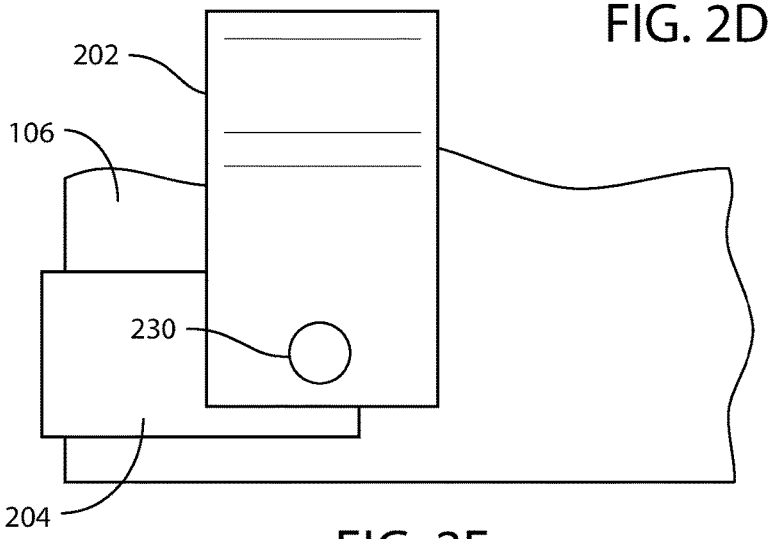
FIG. 2E illustrates a top plan view of the door safety device of FIG. 2A, shown coupled to a door and with the blocking member in a stored configuration.

In some embodiments, the blocking member 202 can be secured to the base/mounting member 204 by a swivel member 230 which is configured to allow the blocking member 202 to rotate about an axis roughly normal to the plane of the door. By such a configuration, the blocking member 202 can be easily moved away from the blocking positions illustrated in FIGS. 2A and 2B, to a position in which the blocking member 202 does not extend (or at least does not significantly extend) beyond the edge of the door, so that the door can be completely closed. In some embodiments, the blocking member 202, the mounting member 204, and/or the swivel member 230 can be configured to create a space between the blocking member 202 and the mounting member 204 (see FIG. 2B), so as to avoid frictional resistance between these two parts during this swiveling or pivoting action. The swivel mechanism 230 can be disposed near the trailing edge of the clip 204 (away from the edge of the door) so that the blocking member 202 can be rotated (e.g., clockwise and/or counterclockwise, by roughly 90 degrees as illustrated in FIGS. 2D and 2E, or by any other angle sufficient to move the blocking member 202 out of a blocking position, e.g. within a range of between about 60 degrees and about 180 degrees in the clockwise and/or counterclockwise direction) and thereby moved out of the blocking position shown in FIG. 2A, into a stored position as illustrated in FIGS. 2D and 2E, in which the door can be completely closed (e.g., a position in which the blocking member 202 extends only along the surface of the door and not significantly past the edge of the door).

Figure 2F:
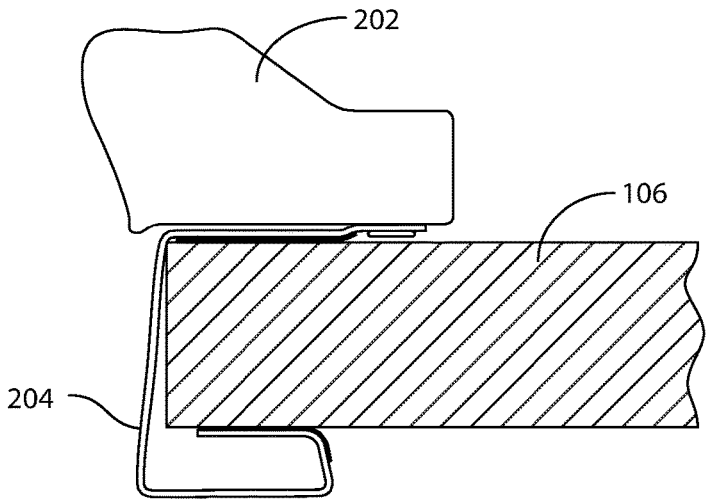
FIG. 2F illustrates a side view of the door safety device of FIG. 2A, shown coupled to a door and with the blocking member in a blocking configuration.
Figure 2G:
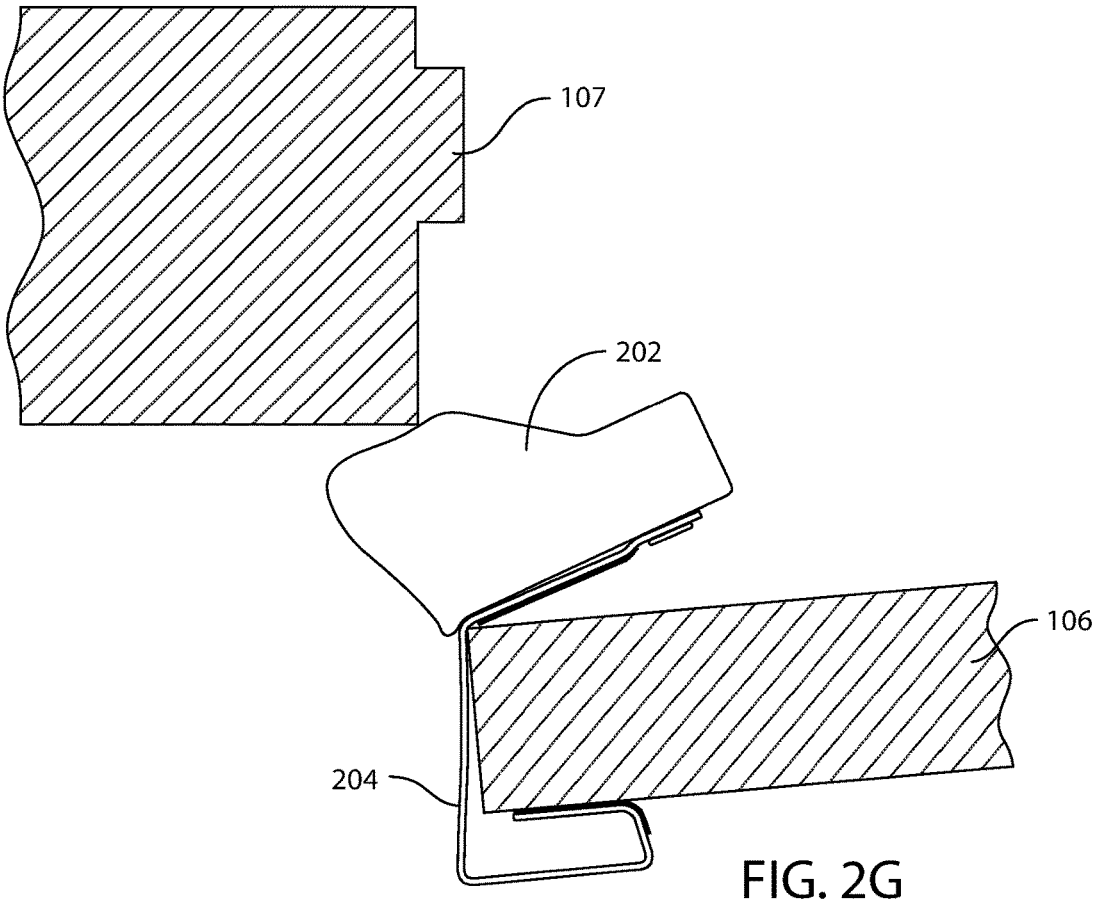
FIG. 2G illustrates another side view of the door safety device of FIG. 2A, shown coupled to a door, with the blocking member impacted by the door jamb and with the blocking member in a blocking orientation.

When the device 200 is mounted to the edge of the door 106 and in a blocking configuration, as shown in FIG. 2F, the blocking member 202 is configured to extend along the surface of the door, in a direction generally parallel to the surface of the door, beyond the edge of the door and beyond the leading edge of the clip 204. The material of the clip 204 (or, at least the material comprising the corner of the clip 204) can be semi-rigid, such that the portion of the clip 204 which extends between the surface of the door and the blocking member forms a hinge axis about which the blocking member 202 can flex or rotate when the blocking member 202 is impacted. As illustrated in FIG. 2G, during an attempted closure of the door 106, the portion of the blocking member 202 which extends beyond the edge of the door 106 impacts the door jamb 107, and the trailing edge of the blocking member 202 flexes away from the surface of the door, along with the portion of the clip 204 to which it is attached. The leading edge of the blocking member 202, which contacts the door jamb, compresses somewhat between the door jamb and the surface of the door, and the trailing edge of the blocking member 202 lifts away from the surface of the door as the blocking member 202 moves to a position in which it is disposed at an angle to the surface of the door, e.g., into a blocking orientation. In such a position, the blocking member 202 can effectively maintain a space between the edge of the door and the door jamb, and block complete closure of the door. The trailing edge of the clip 204 also flexes away from the surface of the door, but the clip maintains its grip on the edge of the door, in part due to the compression of the blocking member 202 (and the clip 204 to which it is attached) near the edge of the door (and thus near the leading edge of the clip 204).

FIGS. 3A-3G illustrate yet another embodiment of a door safety device 300. The device 300 includes a mounting member 304 which is configured to removably attach to the door. The device 300 also includes a blocking member 302 which is operatively coupled to the mounting member 304, and which is movable with respect to the mounting member 304. In the illustrated embodiment, the mounting member 304 comprises a clip which is configured to grip the thickness of the door and thereby removably attach to the edge of the door.

The blocking member 302 can be coupled to the intermediate member 308 via a swivel member 330, such as, for example, a rivet. The blocking member 302 is pivotable with respect to the intermediate member 308 about a pivot axis of the rivet 330, such that when the mounting member 304 is attached to the door 106, the blocking member 302 can be moved between a blocking position (see FIGS. 3A-3C) and a stored position, e.g., a position in which it does not obstruct closure of the door 106 (see FIGS. 3D and 3F).

Figure 3A:
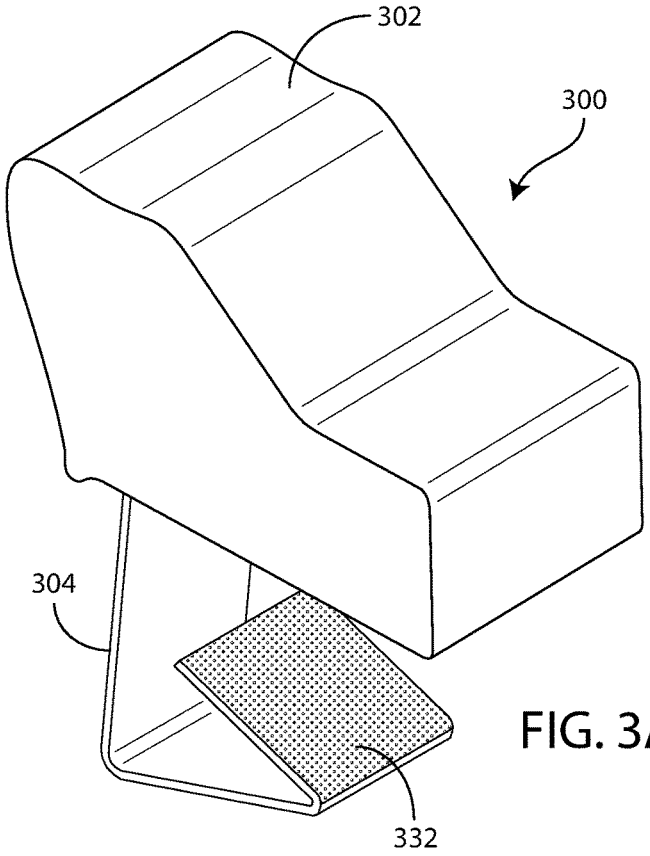
FIG. 3A illustrates a top perspective view of another example of a door safety device, configured in accordance with an embodiment, and shown in an initial or blocking configuration.
Figure 3B:
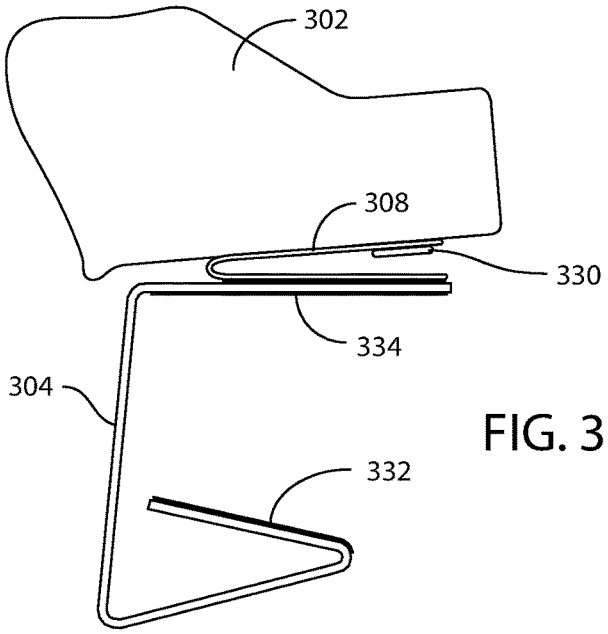
FIG. 3B illustrates a side view of the door safety device of FIG. 3A, shown in a blocking configuration.
Figure 3C:
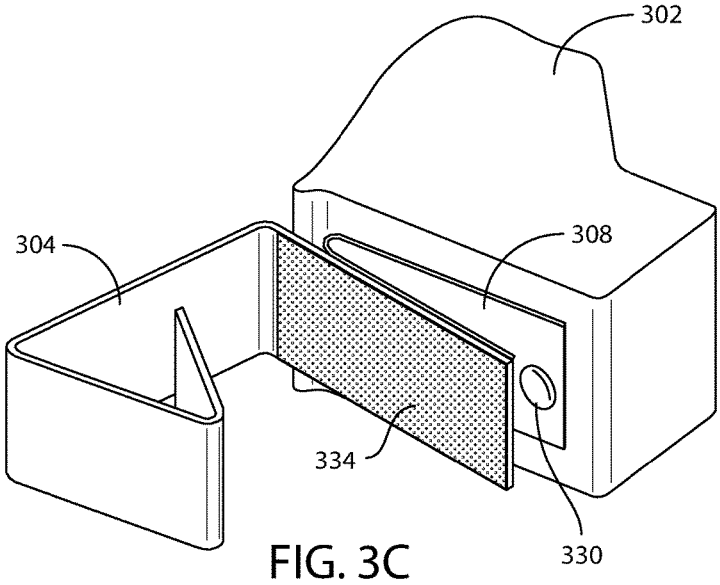
FIG. 3C illustrates a bottom perspective view of the door safety device of FIG. 3A, also in a blocking configuration.
Figure 3D:
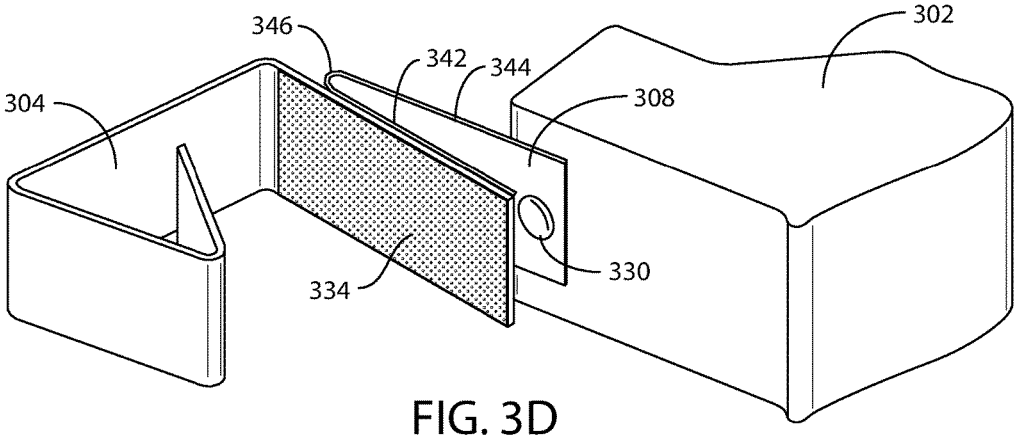
FIG. 3D illustrates a bottom perspective view of the door safety device of FIG. 3A, with the blocking member moved to a stored configuration.
Figure 3E:
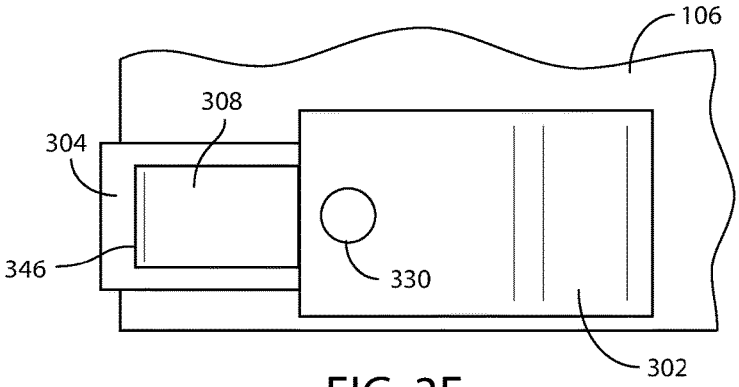
FIG. 3E illustrates a top plan view of the door safety device of FIG. 3A, shown coupled to a door and with the blocking member in a stored configuration.

The blocking member 302 comprises a resilient foam body, which is coupled to the mounting member 304 via an intermediate member 308. In the embodiment illustrated in FIGS. 3A-3G, the intermediate member 308 has a V-shaped cross section. A first leg 342 of the V (also referred to as the "inner" leg) runs parallel to the surface of the door and is attached to the surface of the door, while a second leg 344 of the V (referred to as the "outer" leg) extends at an angle away from the surface of the door; the apex 346 of the V (which in the illustrated embodiment is curved) is disposed near the edge of the door. The two legs 342, 344 can be disposed at an angle of about 2, 3, 4, 5, 10, 15, 20, 25, 30, 40, 45, 50, 55, or 60 degrees with respect to one another, or can be disposed at an angle of less than, greater than, or within a range defined by any of these numbers. The intermediate member can comprise a semi-rigid material (or, in some embodiments, a semi-rigid or otherwise hinged coupling between the two legs 342, 344) such that the two legs 342, 344 are movable with respect to one another about a hinge axis disposed at a region 346 of the intermediate member 308 (the hinge axis extending into and out of the page, as illustrated in FIG. 3B).

Figure 3F:
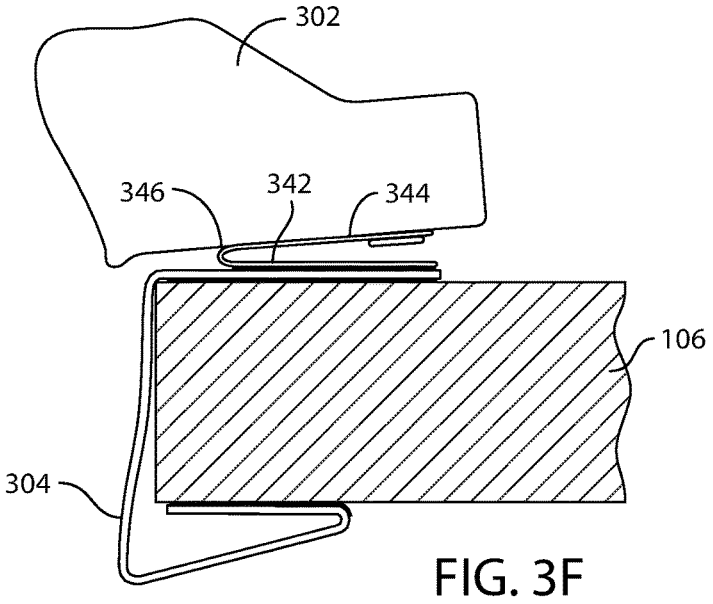
FIG. 3F illustrates a side view of the door safety device of FIG. 3A, shown coupled to a door and with the blocking member in a blocking configuration.
Figure 3G:
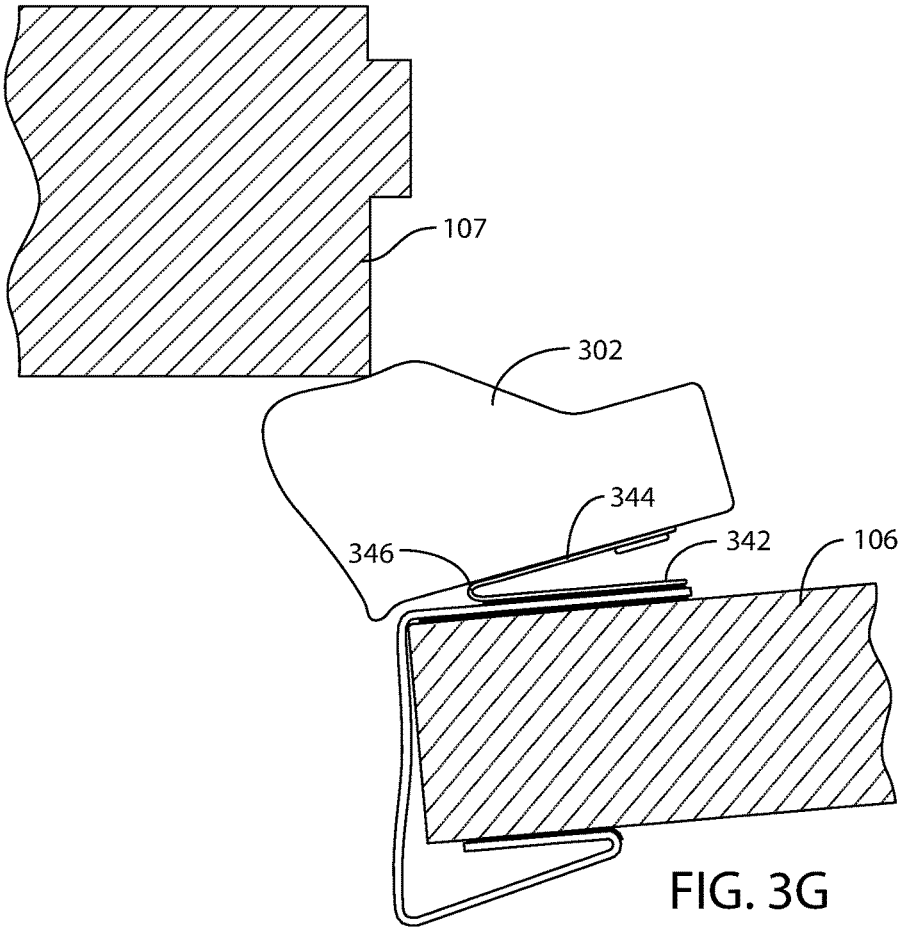
FIG. 3G illustrates another side view of the door safety device of FIG. 3A, shown coupled to a door, with the blocking member impacted by the door jamb and with the blocking member in a blocking orientation.

In the blocking configuration illustrated in FIG. 3F, but before impact, the intermediate member 308 is unstressed. But when the blocking member 302 is impacted by the door jamb 107 or any other object, as illustrated in FIG. 3G, the two legs 342, 344 of the intermediate member 308 can flex open about the hinged coupling 346. As the blocking member 302 is coupled to the outer leg 344 of the intermediate member 308, the blocking member 302 moves with the leg 344 as it flexes open during impact. Such a configuration can serve to inhibit or prevent the transfer of detachment forces from the blocking member 302 to the mounting member 304 upon impact, so that the mounting member 304 can maintain its grip on the edge of the door, thereby reducing the risk that the mounting member 304 might become dislodged from the door upon impact.

Figure 4A:
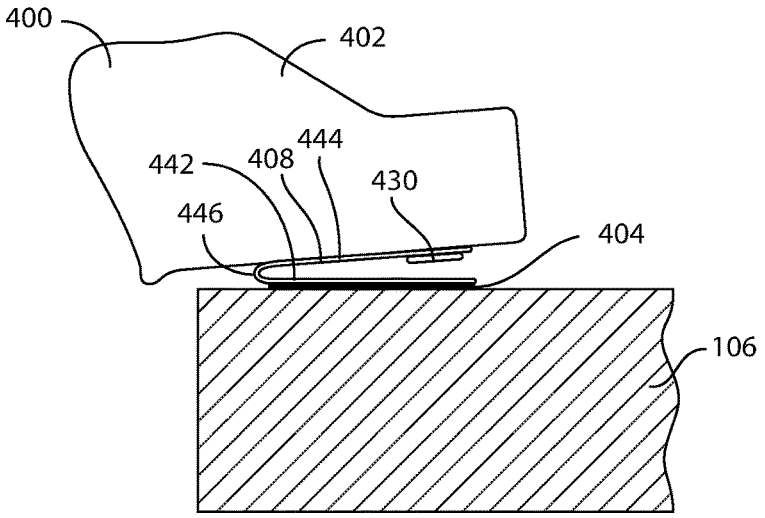
FIG. 4A illustrates a side view of another example of a door safety device, configured in accordance with an embodiment, shown coupled to a door and with the blocking member in a blocking configuration.
Figure 4B:
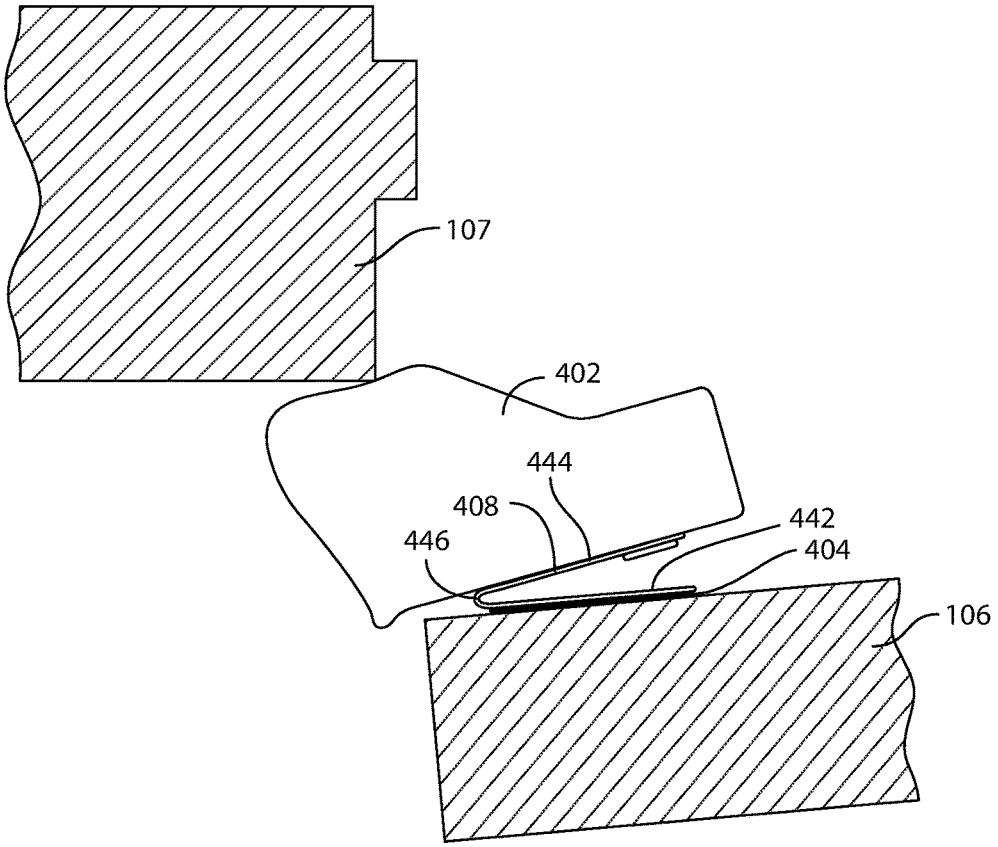
FIG. 4B illustrates another side view of the door safety device of FIG. 4A, shown coupled to a door, with the blocking member impacted by the door jamb and with the blocking member in a blocking orientation.

With reference now to FIGS. 4A and 4B, another example of a door safety device 400 is shown. The device 400 includes a blocking member 402 which is coupled to an intermediate member 408, which is in turn attached to the surface of the door 106 via a mounting member 404. In the embodiment illustrated in FIGS. 4A and 4B, the mounting member 404 comprises a fastener, which can be a removable fastener such as an adhesive strip or hook-and-loop fastener, but other embodiments can employ or a more permanent fastener such as a nail or screw. The intermediate member 408 comprises a V-shaped strip of a rigid or semi-rigid material, such as metal or plastic. A first leg 442 of the V (also referred to as the "inner" leg) runs parallel to the surface of the door and is attached to the surface of the door 106, while a second leg 444 of the V (referred to as the "outer" leg) extends at an angle away from the surface of the door; the apex 446 of the V (which in the illustrated embodiment is curved) is disposed near the edge of the door 106. The blocking member 402 comprises a block of a resilient material, such as elastomer or foam. The blocking member 402 is movably coupled to the outer leg 444 of the V a swivel member 430. In other embodiments, the blocking member 402 can be movably coupled to the outer leg of the V via a hinge member, or can be fixedly coupled to the outer leg of the V, for example via an adhesive or other fastener.

In the blocking position illustrated in FIG. 4A, but before impact, the blocking member 402 extends beyond the apex 446 of the V-shaped intermediate member 408 and beyond the edge of the door 106. The angled outer leg 444 of the intermediate member 408 positions the blocking member 402 at a slight angle with respect to the surface of the door 106. The angle of the V can be selected to place the blocking member 402 in a blocking orientation even before it makes any impact with the door jamb, so that it does not need to move (or at least does not need to move much) in order to achieve the blocking orientation after impact, and so that few or no detachment forces are transferred to the base member 402 upon impact. In some embodiments, incorporating a semi-rigid material into the intermediate member 408 can also result in a slight hinge at the apex 446 of the V shape, creating a vertically-extending pivot axis about which the blocking member 402 can pivot (even if only slightly), for example when the blocking member 402 impacts the door jamb or frame and is compressed by the impact. This hinge or spring action in the intermediate member 408 can also help to prevent detachment forces being transferred from the blocking member 402 to the inner leg 442 of the V (and thus to the mounting member 404) upon impact.

The blocking member 404 can also be rotatable about the swivel member 430, e.g., about an axis extending through the outer leg 444 of the V, so that the blocking member 402 can be easily rotated away from the edge of the door, out of the blocking configuration and into a stored configuration, thereby allowing complete closure of the door 106.

FIGS. 5A-5F illustrate yet another embodiment of a door safety device 500. The device 500 includes a mounting member 504 which is configured to removably attach to the door 106. The device 500 also includes a blocking member 502 which is operatively coupled to the mounting member 504, and which is movable with respect to the mounting member 504 about one or more hinge axes and/or pivot axes of the device 500. In this illustrated embodiment, the mounting member 504 comprises a clip which is configured to grip the thickness of the door and thereby removably attach to the edge of the door. The blocking member 502 comprises a resilient foam body, which is coupled to the mounting member 504 via an intermediate member 508.

In this illustrated embodiment, the intermediate member 508 comprises a tongue portion 556 of the mounting member 504. The blocking member 502 is coupled to the intermediate member 508 via a rivet 530. The blocking member 502 is pivotable with respect to the intermediate member 508 about a pivot axis of the rivet 530, such that when the mounting member 504 is attached to the door 106, the blocking member 502 can be moved between a blocking position (see, e.g., FIG. 5B) and a stored position (see, e.g., FIG. 5D) in which it does not obstruct closure of the door.

Figure 5A:
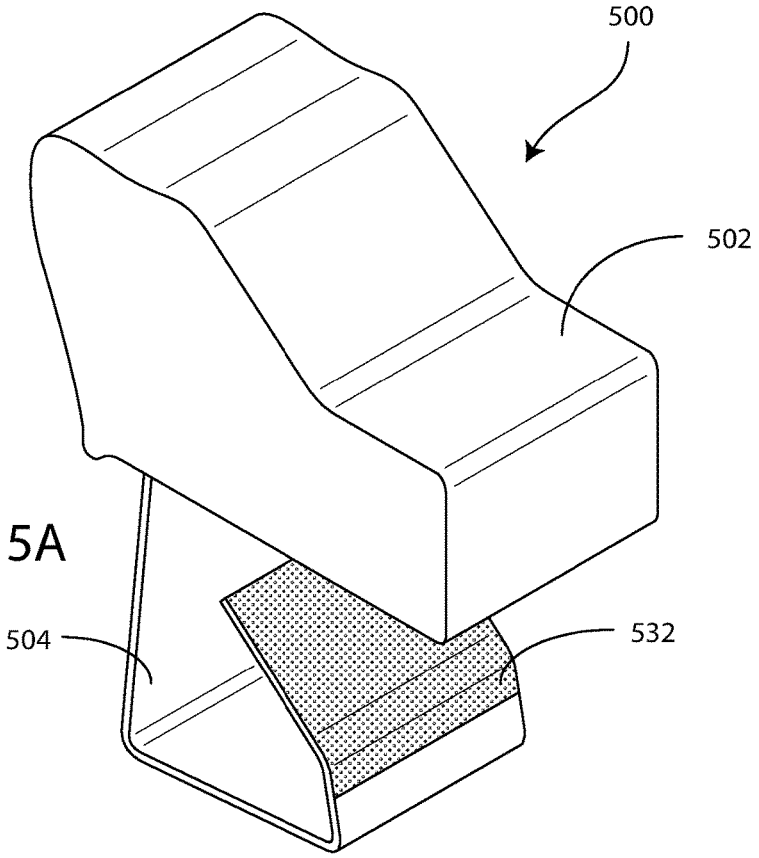
FIG. 5A illustrates a top perspective view of another example of a door safety device, configured in accordance with an embodiment, and shown in an initial or blocking configuration.
Figure 5B:
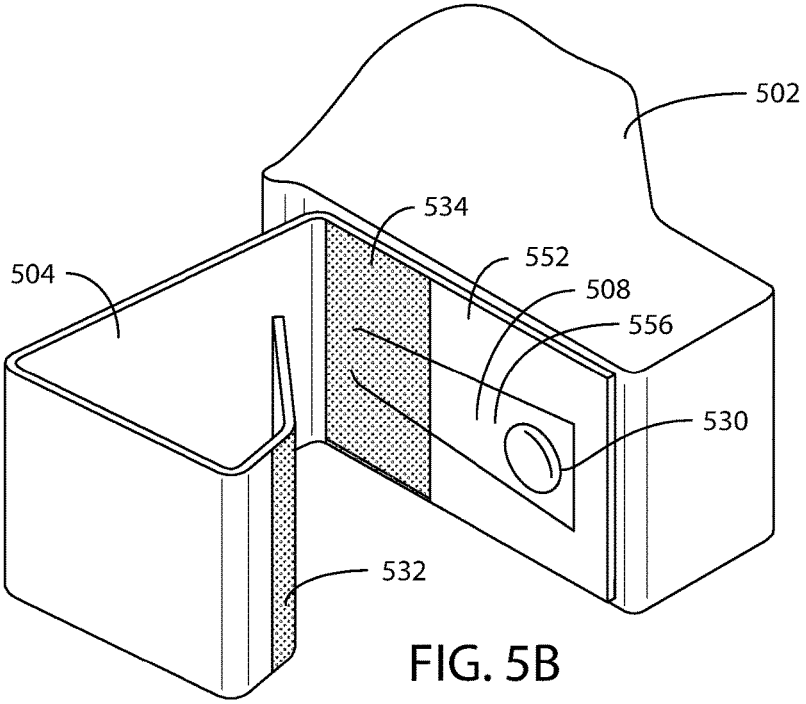
FIG. 5B illustrates a bottom perspective view of the door safety device of FIG. 5A, also in a blocking configuration.
Figure 5C:
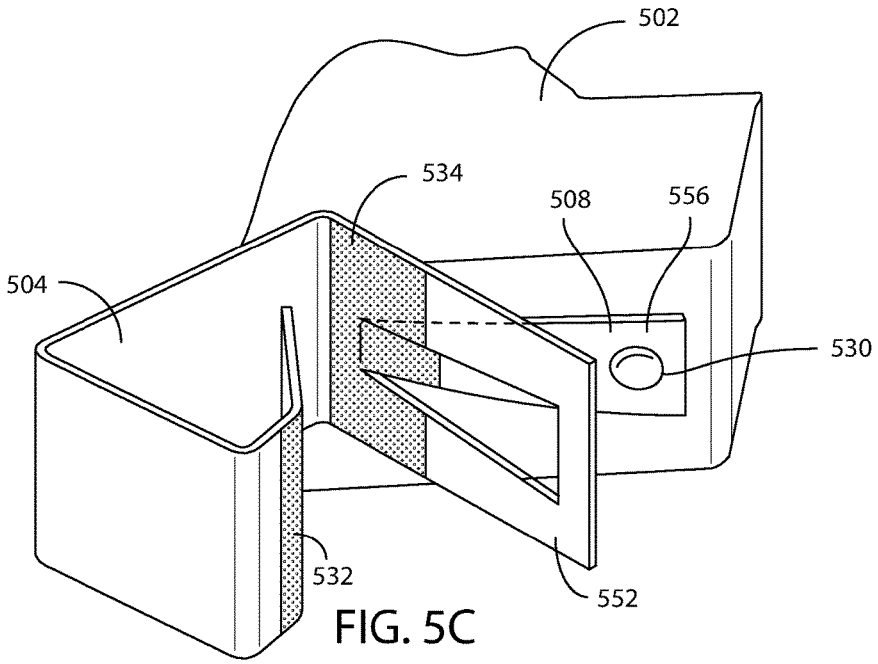
FIG. 5C illustrates another bottom perspective view of the door safety device of FIG. 5A, with the blocking member moved to a blocking orientation, as it would be upon impact.
Figure 5D:
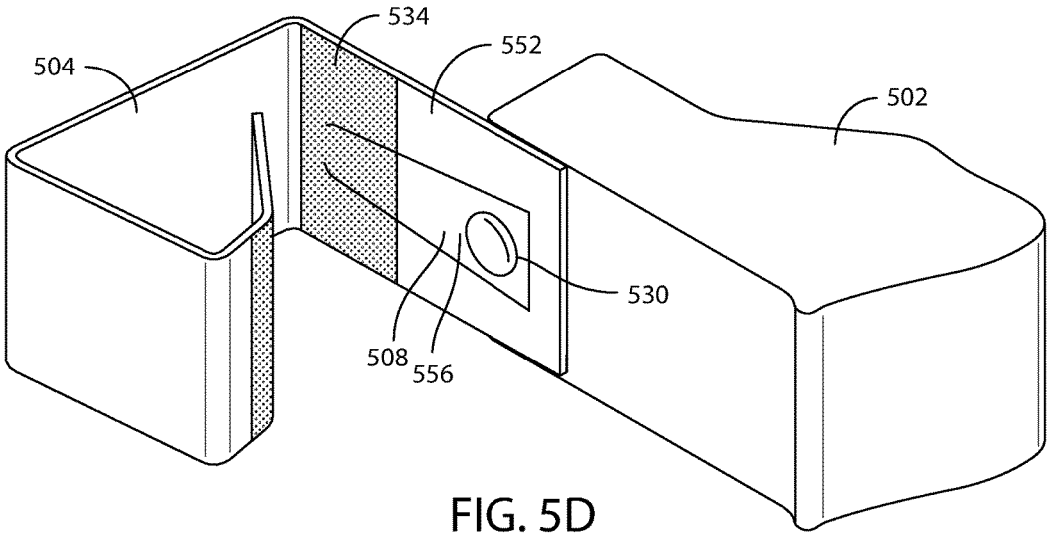
FIG. 5D illustrates another bottom perspective view of the door safety device of FIG. 5A, with the blocking member moved to a stored configuration.

In this illustrated embodiment, the tongue portion 556 is integrally formed with the mounting member 504, and comprises a portion 556 of the mounting member 504 which is separated from a remaining portion 552 of the mounting member 504, for example by a bracket-shaped or U-shaped cut in the mounting member 504. As can be seen in FIG. 5C, with this configuration, the tongue portion 556 of the mounting member 504 can flex away from the remaining portion 552 of the mounting member 504, at a hinge axis disposed at the base of the tongue portion 556. Because the blocking member 502 is coupled to the mounting member 504 via this intermediate member 508, the blocking member 502 can move along with the tongue portion 556 as it flexes away from the remaining portion 552.

Figure 5E:
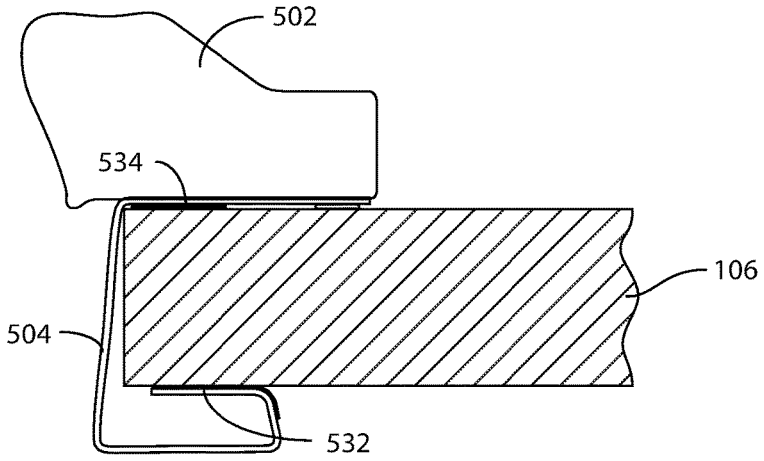
FIG. 5E illustrates a side view of the door safety device of FIG. 5A, shown coupled to a door and with the blocking member in a blocking configuration.
Figure 5F:
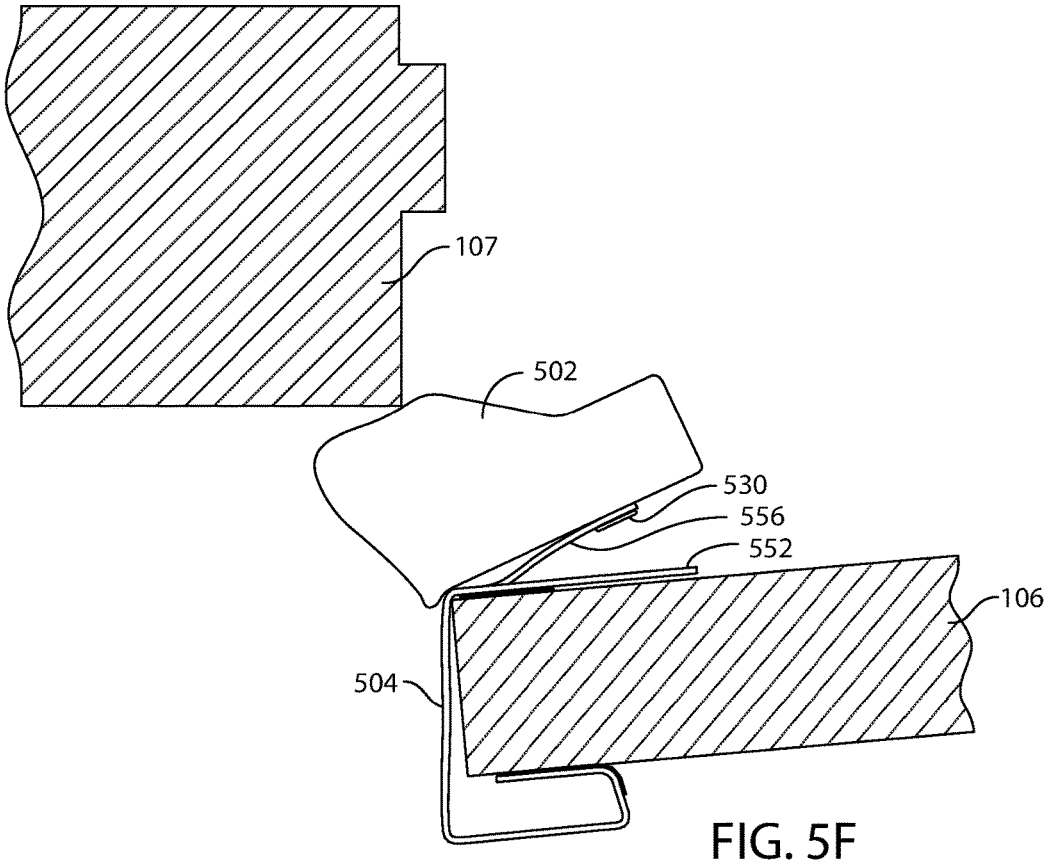
FIG. 5F illustrates another side view of the door safety device of FIG. 5A, shown coupled to a door, with the blocking member impacted by the door jamb and with the blocking member in a blocking orientation.

FIG. 5E illustrates the device 500 mounted to the edge of the door 106, with the blocking member in a blocking configuration, but before being impacted by the door frame 107. FIG. 5F illustrates the device 500 upon impact with the door frame 107, with the blocking member wedged between the door 106 and the door jamb 107 and moved to a blocking orientation, at an angle with respect to the initial blocking configuration shown in FIG. 5E. As can be seen in FIG. 5F, upon impact, the tongue portion 556 flexes away from the surface of the door 106, the blocking member 502 moves with the tongue portion 556 and rotates about the hinge axis formed at the base of the tongue portion 556, and the remaining portion 552 of the mounting member 504 remains seated against the surface of the door 106 so as to maintain the grip of the mounting member 504 on the edge of the door, thereby reducing the possibility that the clip might become dislodged upon impact.

FIGS. 6A-6F illustrate yet another embodiment of a door safety device 600. The device 600 includes a mounting member 604 which is configured to removably attach to the door 106. The device 600 also includes a blocking member 602 which is operatively coupled to the mounting member 604, and which is movable with respect to the mounting member 604 about one or more hinge axes and/or pivot axes of the device 600. In this illustrated embodiment, the mounting member 604 comprises a clip which is configured to grip the thickness of the door and thereby removably attach to the edge of the door. The provision of a tacky material 632, 634 along one or more gripping surfaces of the mounting member 604 can help facilitate the gripping function of the clip.

The blocking member 602 comprises a resilient foam body, which is coupled to the mounting member 604 via an intermediate member 608.

In this illustrated embodiment, the intermediate member 608 comprises a portion 652 of the mounting member 604 which is coupled along a hinge axis to a tongue portion 656 of the mounting member 604. The blocking member 602 is coupled to the intermediate member 608 via a rivet 630. The blocking member 602 is pivotable with respect to the intermediate member 608 about a pivot axis of the rivet 630, such that when the mounting member 604 is attached to the door 106, the blocking member 602 can be moved between a blocking position (see, e.g., FIG. 6B) and a stored position (see, e.g., FIG. 6D) in which it does not obstruct closure of the door.

Figure 6A:
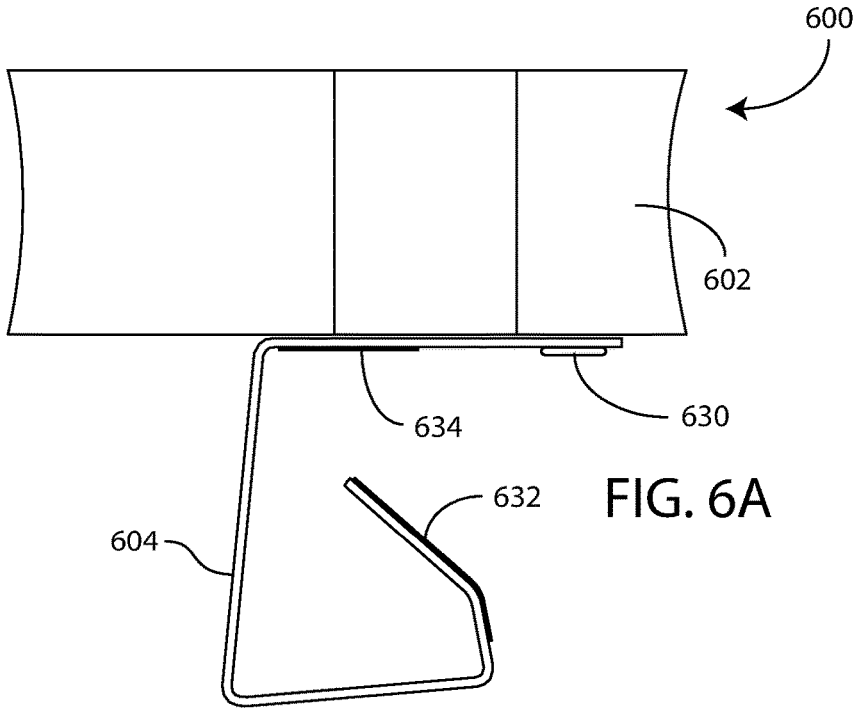
FIG. 6A illustrates a side view of another example of a door safety device, configured in accordance with an embodiment, and shown in an initial or blocking configuration.
Figure 6B:
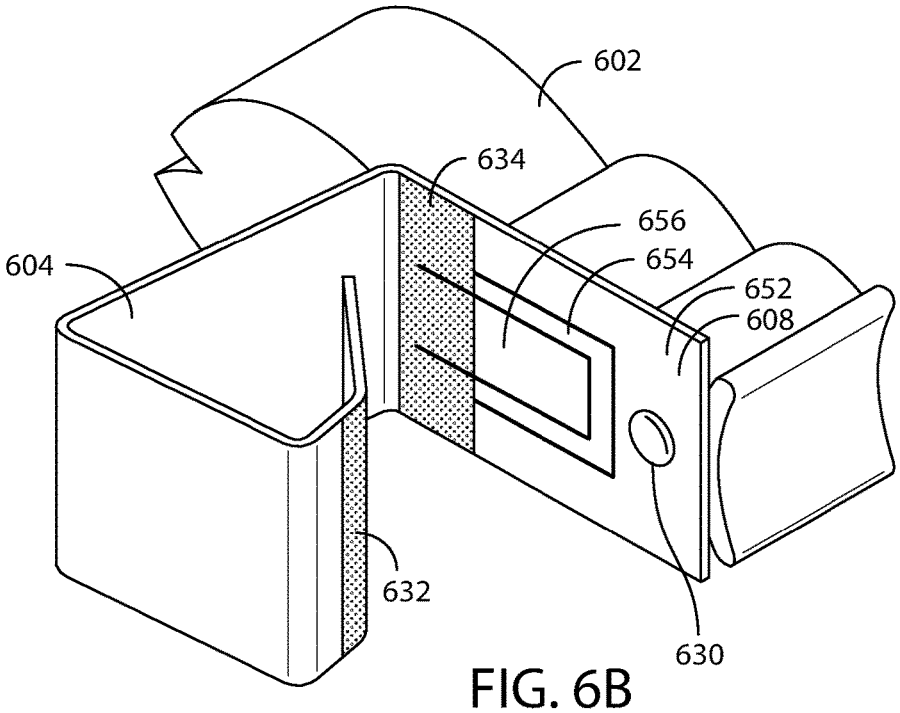
FIG. 6B illustrates a bottom perspective view of the door safety device of FIG. 6A, also in a blocking configuration.
Figure 6C:
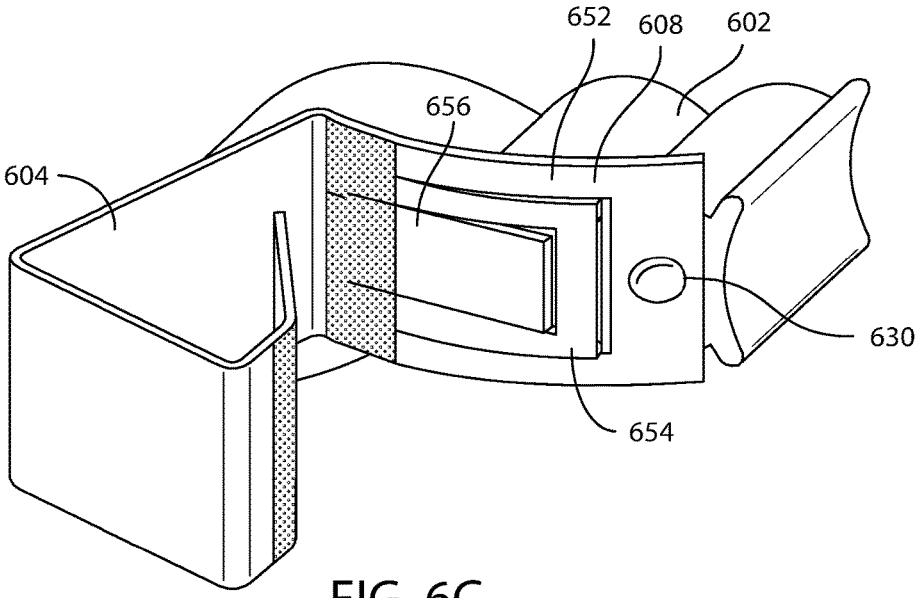
FIG. 6C illustrates another bottom perspective view of the door safety device of FIG. 6A, with the blocking member moved to a blocking orientation, as it would be upon impact.
Figure 6D:
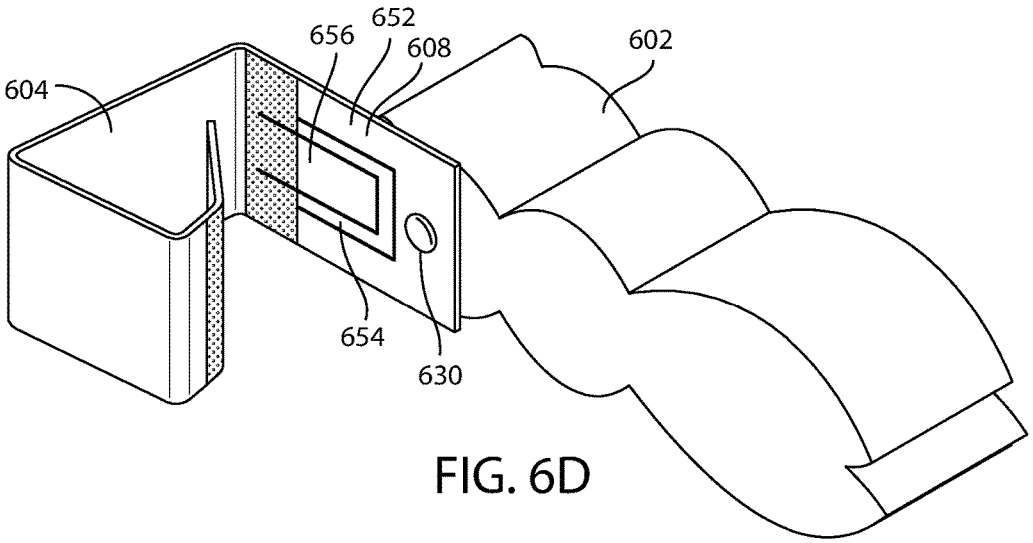
FIG. 6D illustrates another bottom perspective view of the door safety device of FIG. 6A, with the blocking member moved to a stored configuration.

In this illustrated embodiment, the portion 652 is integrally formed with the mounting member 604, and is separated from a tongue portion 656 of the mounting member 604, for example by a bracket-shaped or U-shaped cut or separation in the mounting member 604. As can be seen in FIG. 6C, with this configuration, the intermediate member 608 (including the portion 652) can flex away from the tongue portion 656 of the mounting member 604, at a hinge axis disposed at the base of the tongue portion 656. Because the blocking member 602 in this embodiment is coupled to the mounting member 604 via this intermediate member 608, the blocking member 602 can move along with the portion 652 as it flexes away from the tongue portion 652.

As can also be seen in FIG. 6C, in some embodiments, the intermediate member 608 can also include a secondary portion 654 which is hingedly coupled to the tongue portion 656 and/or to the portion 652 along a hinge axis formed at the base of the secondary portion 654. In this illustrated embodiment, the secondary portion is integrally formed with both the tongue portion 656 and the portion 652, and is rendered movable or flexible with respect to these portions by, for example, a bracket-shaped or U-shaped cut or separation in the mounting member 604. In some embodiments, the provision of a flexible and/or hinged secondary portion 654 between the blocking member 602 and the mounting member 604, which creates a secondary hinge axis about which the blocking member 602 can revolve upon impact, can serve to further limit the transfer of detachment forces from the blocking member 602 to the mounting member 604 upon impact.

Figure 6E:
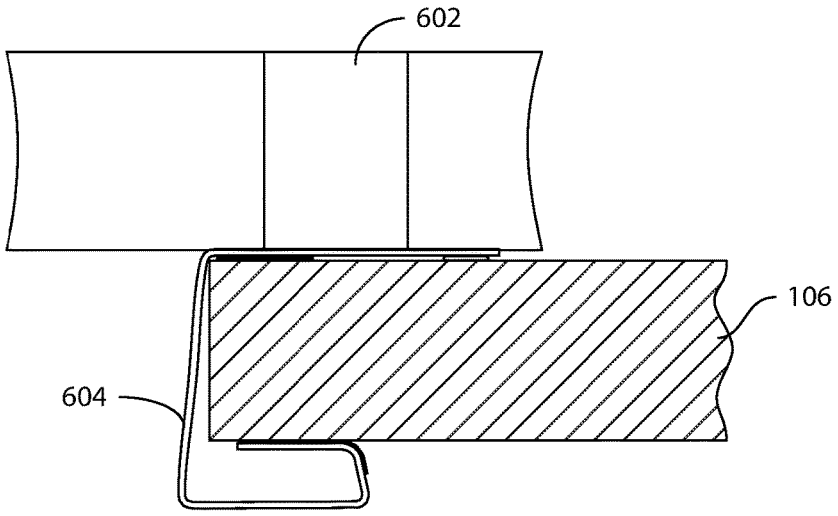
FIG. 6E illustrates a side view of the door safety device of FIG. 6A, shown coupled to a door and with the blocking member in a blocking configuration.
Figure 6F:
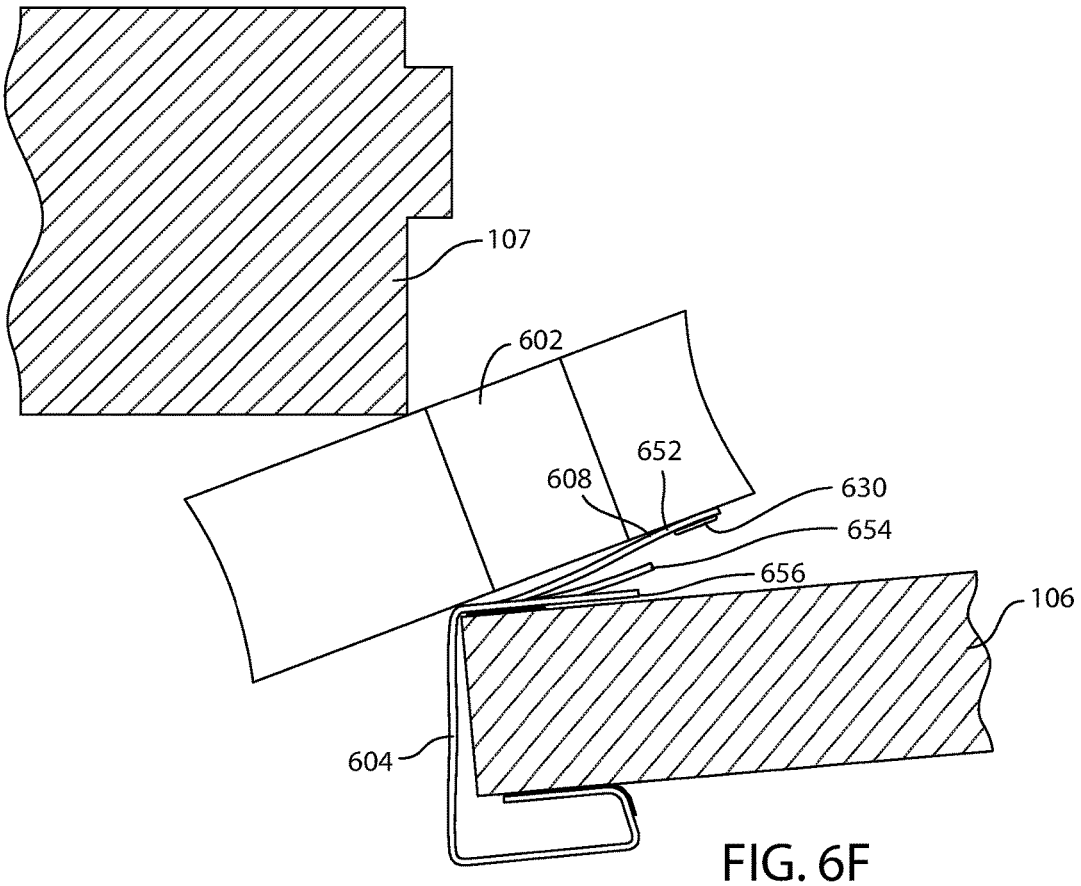
FIG. 6F illustrates another side view of the door safety device of FIG. 6A, shown coupled to a door, with the blocking member impacted by the door jamb and with the blocking member in a blocking orientation.

FIG. 6E illustrates the device 600 mounted to the edge of the door 106, with the blocking member 602 in a blocking configuration, but before being impacted by the door frame 107. FIG. 6F illustrates the device 600 upon impact with the door frame 107, with the blocking member 602 wedged between the door 106 and the door jamb 107 and moved to a blocking orientation, at an angle with respect to the initial blocking configuration shown in FIG. 6E. As can be seen in FIG. 6F, upon impact, the intermediate member 608 flexes away from the surface of the door 106, the blocking member 602 moves with the intermediate member 608 and revolves about the hinge axis formed at the base of the tongue portion 656, and the tongue portion 656 remains seated against the surface of the door 106 so as to maintain the grip of the mounting member 504 on the edge of the door, thereby reducing the possibility that the clip might become dislodged upon impact.

Figure 7A:
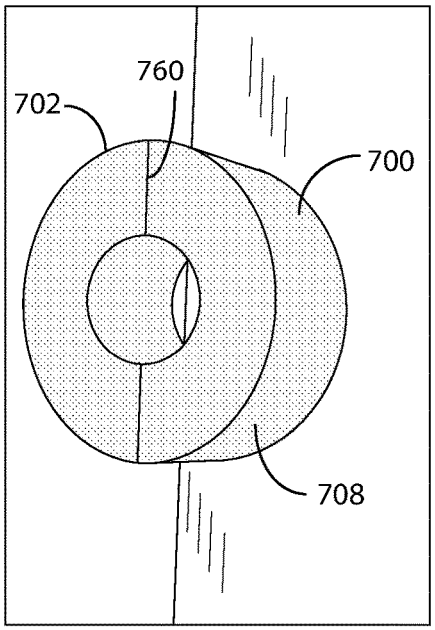
FIG. 7A illustrates a perspective view of another example of a door safety device, configured in accordance with an embodiment, and shown coupled to a door with the blocking member in a blocking configuration.
Figure 7B:
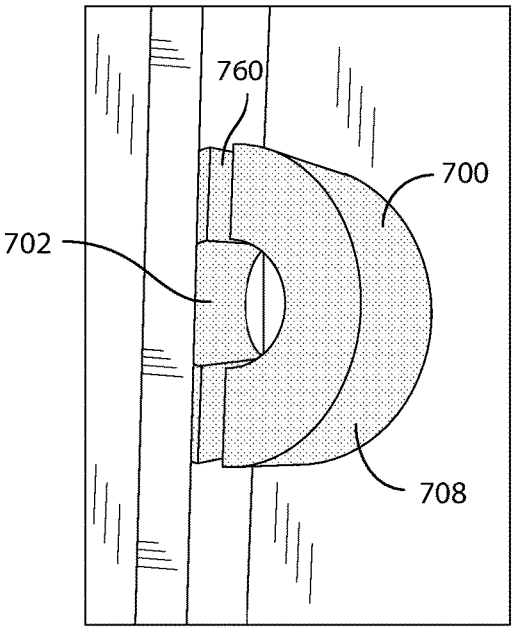
FIG. 7B illustrates another perspective view of the door safety device of FIG. 7A, shown coupled to a door, with the blocking member impacted by the door jamb and with the blocking member in a blocking orientation.

With reference now to FIGS. 7A-7D, another example of a door safety device 700 is shown. The device 700 includes a base member 708 which is configured to be secured to a surface of the door 106, and a blocking member 702 which is movable with respect to the base member 708. In the illustrated embodiment, the base member 708 and the blocking member 702 are integrally formed as a single piece of a resilient material, such as a foam or an elastomeric material. In the position illustrated in FIG. 7A, the blocking member 702 extends beyond the edge of the door 106. The foam material is slit partway through the thickness of the blocking member 702, near the edge of the door 106, along cut 760, in a plane roughly parallel to the edge of the door, so as to form a vertical hinge axis about which the blocking member 702 can pivot with respect to the base member 708 and move into a blocking orientation, for example when the blocking member 702 impacts the door jamb or frame 107. FIG. 7B shows the configuration of the device 700 during an attempted closure of the door 106—the blocking member portion 702 of the device 700 has pivoted away from the base member portion 704 of the device 700, wedging between the edge of the door 106 and the door jamb 107 at an angle and maintaining at least a finger's width of space between the door and the door jamb. Due to the provision of the hinge axis created by the cut 760, the base member portion 708 of the device remains securely attached to the door 106, without detachment forces transferring from the blocking member 702 to the base member 704.

As with other embodiments described herein, the base member 708 can be attached to the door 106 using adhesive, hook and loop fasteners, or any other suitable fastener, including more permanent fasteners such as nails or screws if desired. The base member 708 can be directly attached to the door 106 or can be indirectly attached via another mounting member (for example and without limitation, a piece of plastic or other material which is itself mounted to the door, and which the base member is then adhered or otherwise affixed to). The base member 708 can also be secured to the door 106 and/or to a mounting member by a swivel mechanism 730 which is configured to allow the base member 708 (and the blocking member 702 which is coupled thereto) to rotate about an axis normal to the plane of the door, so that the blocking member 702 can be moved out of the blocking position and into a stored position in which the door can be completely closed.

Figure 7C:
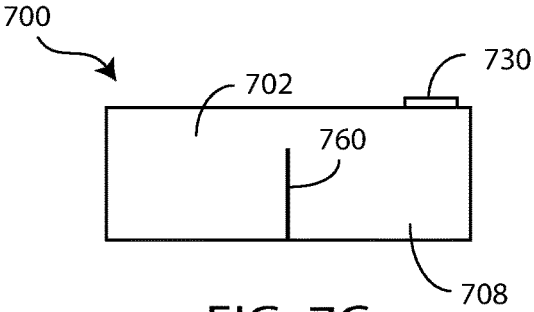
FIG. 7C illustrates a side view of the door safety device of FIG. 7A.
Figure 7D:
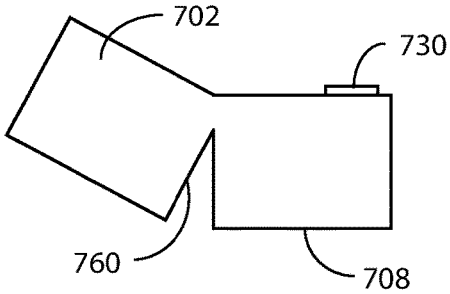
FIG. 7D illustrates another side view of the door safety device of FIG. 7A, with the blocking member moved to a blocking orientation, as it would be upon impact.

FIG. 7C illustrates a side view of the door safety device 700, with the blocking member 702 in a blocking configuration, as it would be before impact. FIG. 7D illustrates another side view of the door safety device 700, with the blocking member 700 moved to a blocking orientation, as it would be upon impact. In embodiments, the provision of a hinge axis which allows the blocking member 702 to rotate from an initial position to a blocking orientation upon impact can serve to minimize the transfer of detachment forces from the blocking member 702 to the base member 708 (and/or to any additional mounting structures which may be present to couple the device 700 to the door).

In embodiments, providing a blocking member comprising a resilient and/or compressible material, at least on the portions which contact the door and/or door jamb during an attempted closure of the door, can help to dampen sound on impact, reduce any rebound effect which might otherwise occur with a more rigid blocking member, and can also help to lessen the transfer of detachment forces from the blocking member to the base member (and/or mounting member, if separate from the base member) upon impact.

Embodiments can also include a hinge member coupling the base member to the mounting member, creating a vertically-extending hinge axis about which the base member can pivot with respect to the mounting member, particularly upon impact. Additionally or in the alternative, embodiments can include a hinge member coupling the blocking member to the base member, creating a vertically-extending hinge axis about which the blocking member can pivot with respect to the base member, particularly upon impact. Providing hinged couplings described herein in connection with embodiments can also serve to reduce the transfer of detachment forces from the blocking member to the base member (and/or mounting member, if separate from the base member) upon impact.

Further, embodiments can include a swivel mechanism, creating a pivot axis (e.g., extending in a direction normal to the surface of the door, parallel to the surface of the door, normal to a surface of the blocking member or base member, parallel to a surface of the blocking member or base member, or at any suitable angle with respect to any of these surfaces) about which the blocking member can pivot with respect to the base member (and/or mounting member, if separate from the base member), allowing the blocking member to be moved out of a blocking position and into a stored position when desired.

In some embodiments, the mounting member, base member, intermediate member, and/or the blocking member can be separate components which are coupled or otherwise connected together by any suitable mechanical coupling, e.g., by one or more hinge members. In other embodiments, the member, base member, intermediate member, and/or the blocking member can be integrally formed with one another, with one or more integrally-formed hinged couplings between parts to create hinge axes or pivot axes configured to allow relative movement of the parts, particularly upon, during, and/or after impact of the blocking member with a door frame, jamb, or other object, and thereby achieve the goals described herein. The mounting member and/or base member can be a plate or strip of rigid material, such as plastic, which is adhered to or otherwise affixed to the surface of the door. In addition or in the alternative, the mounting member and/or base member can comprise a flexible member configured to couple the blocking member and/or intermediate member to the surface of the door, such as, for example, a double-sided adhesive tape or foam, or a hook and loop fastener. In some embodiments, the mounting member can be a strip of metal or plastic which is bent or otherwise formed into a spring clip, which is designed to grip the edge of a door from both sides. Such a spring clip can be configured to securely grip doors of a variety of widths, for example by including a return section configured to grip the opposite surface of the door from the blocking member side (see, e.g., FIG. 2A; the portion of the clip 204 in the region of tacky member 232), which return section can compress to varying degrees so that the clip can accommodate doors of varying widths. In embodiments, the blocking member can comprise one or more layers or sections of a rigid or semirigid material, such as plastic, and/or of a resilient material, such as an elastomeric or foam material.

In embodiments, the blocking member can have any size, shape, or construction suitable for purposes of receiving the impact of a door frame or jamb on a closing door, preventing complete closure of the door, and maintaining at least a finger's width of space between the door frame or jamb when in the blocking configuration. The mounting member can have any size, shape, or construction suitable for purposes of coupling the blocking member (directly or indirectly) to a surface and/or edge of the door, while allowing complete closure of the door when the blocking member is in a stored configuration.

In embodiments, the device can be configured such that the blocking member is movable with respect to the mounting member, for example rotatable, revolvable, or flexible about one or more hinge axes or pivot axes, or slidable along a track or axis extending towards and away from the edge of the door, such that the blocking member can be moved out of a blocking configuration and into a stored configuration by the user (at least while the door is open), thereby allowing complete closure of the door without necessarily requiring removal of the device from the door. The one or more hinge axes or pivot axes can extend in a direction normal to or parallel to a surface and/or an edge of the door, or at an angle with respect to a surface or edge of the door.

In embodiments, the device can be configured such that the blocking member is movable with respect to the mounting member, for example rotatable, revolvable, or flexible about one or more hinge axes or pivot axes, or slidable along a track or axis extending towards and away from the edge of the door, such that the blocking member can move from an initial blocking configuration and into a blocking orientation (e.g., angled with respect to the initial blocking configuration) upon, during, and/or after impact of the door frame or jamb on the door, thereby minimizing the transfer of detachment forces from the blocking member to the mounting member upon, during, and/or after impact. The one or more hinge axes or pivot axes can extend in a direction normal to or parallel to a surface and/or an edge of the door, or at an angle with respect to a surface or edge of the door.

In embodiments, the device can be configured such that the blocking member lays in a direction generally parallel to the surface of the door when in the blocking configuration. In other embodiments, the device can be configured such that the blocking member extends at an angle towards the door frame or door jamb when in the blocking configuration. In embodiments, the blocking member can extends past the edge of the door so as to block complete closure of the door when in the blocking configuration.

In some embodiments, the device can include a biasing member coupled between the mounting member, base member, and/or intermediate member and the blocking member. For example, embodiments can include a spring which extends from the mounting member, base member, and/or intermediate member into a receptacle in the blocking member. The biasing member can be configured to allow the blocking member to move from a position parallel to the surface of the door, into a position angled into the space between the door and the door jamb, when the blocking member impacts the door jamb. The biasing member can further be configured to pull the blocking member back to a position flush with the mounting member or base member (e.g., flush with the surface of the door) when the door is opened.

The various embodiments of door safety devices described above thus provide a number of ways to facilitate prevention of finger injuries in doorways without necessarily requiring a permanent attachment of the device to the door, while limiting the likelihood that the device will become dislodged upon impact, and also while allowing complete closure of the door if/when desired. Of course, it is to be understood that not necessarily all such objectives or advantages may be achieved in accordance with any particular embodiment using the systems described herein. Thus, for example, those skilled in the art will recognize that the systems may be developed in a manner that achieves or optimizes one advantage or group of advantages as taught herein without necessarily achieving other objectives or advantages as may be taught or suggested herein.

Further, although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present system has been described in the context of a particularly configured volleyball court, the skilled artisan will appreciate, in view of the present disclosure, that certain advantages, features and aspects of the system may be realized in a variety of other applications, many of which have been noted above.

Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims that follow.

What is claimed is:

1. A door safety device comprising:

a mounting member configured to couple to a surface of a door;

a blocking member configured to prevent complete closure of the door, at least when the mounting member is attached to a surface of the door and the device is in a blocking configuration; and an intermediate member coupled between the mounting member and the blocking member, the intermediate member comprising a tongue portion and a remainder portion and defining a first hinge axis, the first hinge axis configured to extend in a direction parallel to the surface of the door and parallel to an edge of the door, at least when the mounting member is coupled to the surface of the door, the tongue portion being movable with respect to the remainder portion about the first hinge axis, wherein at least a distal portion of the blocking member is movable about the first hinge axis away from the surface of the door upon impact of the door with the blocking member during an attempted closure of the door, at least when the mounting member is coupled to the surface of the door and the device is in a blocking configuration.

2. The door safety device of claim 1, whereby the blocking member is configured to move from an initial blocking configuration to a blocking orientation upon impact with a door jamb, the blocking orientation being angled with respect to the initial blocking configuration.

3. The door safety device of claim 1, wherein the blocking member comprises a resilient member.

4. The door safety device of claim 1, wherein the blocking member comprises an elastomer.

5. The door safety device of claim 1, wherein the blocking member comprises foam.

6. The door safety device of claim 1, wherein the mounting member comprises a clip configured to grip opposing surfaces of the door.

7. The door safety device of claim 6, further comprising a tacky material disposed on at least one gripping surface of the clip.

8. The door safety device of claim 1, wherein the mounting member comprises an adhesive.

9. The door safety device of claim 1, wherein the mounting member comprises a hook-and-loop fastener.

10. The door safety device of claim 6, wherein the tongue portion comprises a leg of the clip.

11. The door safety device of claim 1, wherein the blocking member is coupled to the tongue portion.

12. The door safety device of claim 1, wherein the blocking member is coupled to the remainder portion.

13. The door safety device of claim 1, wherein the tongue portion and the remainder portion together comprise a V-shaped member, one of the tongue portion and the remainder portion being coupled to the mounting member, the other of the tongue portion and the remainder portion being coupled to the blocking member, and an apex of the V-shaped member defining the first hinge axis.

14. The door safety device of claim 1, further comprising a second hinge member defining a second hinge axis, wherein the blocking member is movable about the second hinge axis relative to the surface of the door, at least when the mounting member is coupled to the surface of the door and the device is in a blocking configuration.

15. The door safety device of claim 1, wherein the blocking member is movable between the blocking configuration and a stored configuration in which the blocking member does not prevent complete closure of the door.

16. The door safety device of claim 15, further comprising a pivot member defining a pivot axis, wherein the blocking member is configured to rotate about the pivot axis as it moves from the blocking configuration to the stored configuration.

17. The door safety device of claim 16, wherein the pivot axis extends in a direction normal to the surface of the door.

18. A door safety device comprising:

a blocking member configured to receive an impact of a door frame or door jamb during an attempted closure of a door and to prevent complete closure of the door;

an attachment member configured to couple the blocking member to a surface of the door; and a remedial member comprising a tongue portion and a remainder portion, the tongue portion being movable with respect to the remainder portion, the remedial member being configured to enable at least a distal portion of the blocking member to move away from the surface of the door about an axis extending in a direction parallel to the surface of the door and parallel to an edge of the door at least when the blocking member is impacted by the door frame or door jamb during an attempted closure of the door so as to inhibit transfer of detachment forces from the blocking member to the attachment member during impact.

19. The door safety device of claim 18, wherein the detachment forces include a force component extending in a direction normal to the surface of the door and away from the surface of the door.

20. A door safety device comprising:

a base member configured to attach to a surface of a door, the base member comprising a tongue portion and a remainder portion, the tongue portion and the remainder portion being movable with respect to one another about a hinge axis extending in a direction parallel to the surface of the door and parallel to an edge of the door; and a blocking member operatively coupled to the base member via at least one of the tongue portion and the remainder portion, at least a distal portion of the blocking member being movable relative to the base member and away from the surface of the door about the hinge axis upon impact of the blocking member with a door frame or door jamb during an attempted closure of the door, between a first position in which the blocking member extends beyond an edge of the door at a first angle with respect to the surface of the door, and a second position in which the blocking member extends beyond the edge of the door at a second angle with respect to the surface of the door.

* * * * *